US009399988B2

(12) United States Patent
Brooke et al.

(10) Patent No.: US 9,399,988 B2
(45) Date of Patent: Jul. 26, 2016

(54) VARIABLE CAPACITY COMPRESSOR AND REFRIGERATOR

(75) Inventors: Richard Dana Brooke, Louisville, KY (US); Martin Christopher Severance, Louisville, KY (US); Gary Owen Scheldorf, Louisville, KY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1012 days.

(21) Appl. No.: 13/364,436

(22) Filed: Feb. 2, 2012

(65) Prior Publication Data

US 2013/0199223 A1 Aug. 8, 2013

(51) Int. Cl.

| | |
|---|---|
| ***F25B 49/02*** | (2006.01) |
| ***F04B 39/12*** | (2006.01) |
| ***F25B 1/02*** | (2006.01) |
| ***F25D 11/02*** | (2006.01) |
| ***F04B 49/22*** | (2006.01) |
| *F25B 1/10* | (2006.01) |
| *F25B 5/02* | (2006.01) |

(52) U.S. Cl.

CPC ..... *F04B 39/122* (2013.01); *F04B 39/123* (2013.01); *F04B 49/22* (2013.01); *F25B 1/02* (2013.01); *F25B 49/022* (2013.01); *F25D 11/022* (2013.01); *F25B 1/10* (2013.01); *F25B 5/02* (2013.01); *F25B 2400/13* (2013.01); *F25B 2600/0262* (2013.01); *F25B 2600/2507* (2013.01); *F25B 2600/2509* (2013.01); *F25B 2600/2521* (2013.01); *F25D 2700/14* (2013.01)

(58) Field of Classification Search

CPC ..... F25B 1/02; F25B 31/02; F25B 49/022; F25B 2600/0262; F04B 39/122; F04B 39/123; F04B 49/16; F04B 49/24

USPC ..... 62/196.1, 228.1, 228.5; 417/278, 292, 417/440, 499

See application file for complete search history.

(56) References Cited

U.S. PATENT DOCUMENTS

| | | | | |
|---|---|---|---|---|
| 2,006,584 | A | 7/1935 | De Puy | |
| 2,112,791 | A | 3/1938 | Small et al. | |
| 3,759,057 | A * | 9/1973 | English et al. | 62/196.3 |
| 4,506,517 | A * | 3/1985 | Pandzik | F04B 49/065 417/298 |
| 5,529,461 | A * | 6/1996 | Kawaguchi | F04B 27/1018 417/222.2 |
| 5,816,201 | A * | 10/1998 | Garvin | F02F 7/0019 123/197.3 |
| 6,231,314 | B1 * | 5/2001 | Murakami | F04B 27/1018 417/222.1 |
| 6,352,057 | B1 * | 3/2002 | Drecq | F02B 33/20 123/197.3 |
| 6,694,764 | B1 * | 2/2004 | Eckstein, Jr. | A23B 4/16 417/222.2 |
| 2009/0277197 | A1 * | 11/2009 | Gambiana | F25B 39/028 62/115 |
| 2010/0021318 | A1 * | 1/2010 | Makishima | F04B 27/1018 417/269 |

FOREIGN PATENT DOCUMENTS

| | | |
|---|---|---|
| EP | 146993 B1 | 3/1988 |

* cited by examiner

*Primary Examiner* — Jonathan Bradford
(74) *Attorney, Agent, or Firm* — Dority & Manning, PA

(57) ABSTRACT

A reciprocating refrigerant compressor system is disclosed. The compressor system includes a cylinder, a piston disposed within the cylinder, at least one fluid passageway, and an actuator. The piston is movable between a bottom dead center (BDC) and a top dead center (TDC) position. The fluid passageway is disposed within the cylinder between the BDC and TDC position and defined by one or more apertures. The actuator is in operative communication with the aperture and is responsive to an environmental condition external to the compressor system to at least partially close the aperture.

19 Claims, 23 Drawing Sheets

VARIABLE CAPACITY COMPRESSOR AND REFRIGERATOR

BACKGROUND OF THE DISCLOSURE

The present disclosure generally relates to reciprocating compressors, and more particularly to reciprocating refrigerant compressors for cooling appliances.

Modern refrigerators typically include a closed refrigeration circuit having a compressor, an evaporator, a condenser, and a number of fans to direct cooled air into refrigeration compartments. Refrigerators typically function under multiple conditions, which may include long periods of low demand during which the compressor runs for a short period of time and remains off for a long period of time, as well as short periods of high demand during which the compressor runs steadily through the period of high demand (such as during meal preparation, frequent door openings, accelerated cooling modes, automatic icemaker use, and high ambient temperature, for example). Present refrigerator designs must have sufficient capacity to operate and supply the necessary cooling for high demand, and typically include a large single capacity compressor to meet the high demand. The requirement to satisfy high demand operation presents a difficulty to efficiently operate during low demand operation. A motor driving the compressor with displacement sufficient to meet high demand must be sized to supply the starting torque required for the compressor, which requires greater current (and thus, motor size) than steady-state torque. During periods of low demand, a compressor sized for high demand provides excess capacity, runs infrequently, and can lead to complications in high efficiency refrigerators, such as greater cyclic losses, power consumption, sweat, and compartment temperature fluctuation with low ice rate and reduced motor efficiency, for example. Accordingly, there exists a need for a refrigeration compressor arrangement to overcome these drawbacks.

Accordingly, it would be desirable to provide a system that addresses at least some of the problems identified above.

BRIEF DESCRIPTION OF THE DISCLOSED EMBODIMENTS

As described herein, the exemplary embodiments overcome one or more of the above or other disadvantages known in the art.

One aspect of the disclosed embodiments relates to a reciprocating refrigerant compressor system. In one embodiment the compressor system includes a cylinder, a piston disposed within the cylinder, at least one fluid passageway and an actuator. The piston is movable between a bottom dead center (BDC) and a top dead center (TDC) position. The fluid passageway is disposed within the cylinder between the BDC and TDC position and is defined by one or more apertures. The actuator is in operative communication with the aperture and responsive to an environmental condition external to the compressor system to close the aperture.

Another aspect of the disclosed embodiments relates to a refrigerator. In one embodiment, the refrigerator includes a cabinet, a refrigeration compartment within the cabinet, and a sealed system for forcing cold air through the refrigeration compartment. The sealed system includes a compressor having a cylinder, a piston disposed within the cylinder, a fluid passageway, an actuator, and a controller in signal communication with the actuator. The piston is movable between a bottom dead center (BDC) and a top dead center (TDC) position. The fluid passageway is defined by an aperture disposed within the cylinder between the BDC and TDC position and is in operative communication with the actuator. The controller is responsive to an environmental condition of the refrigeration compartment to activate the actuator to close the aperture.

A further aspect of the disclosed embodiments relates to a refrigerator. In one embodiment, the refrigerator includes a cabinet, a refrigeration compartment having a fresh food and freezer compartment within the cabinet, and a sealed system for forcing cold air through the refrigeration compartment. The sealed system includes a compressor having a cylinder, a piston disposed within the cylinder, a fluid passageway, an actuator, and a controller in signal communication with the actuator. The piston is movable between a bottom dead center (BDC) and a top dead center (TDC) position. The fluid passageway is defined by an aperture disposed within the cylinder between the BDC and TDC position and is in operative communication with the actuator. The controller is responsive to an environmental condition of the refrigeration compartment to activate the actuator to close the aperture. The sealed system further includes a condenser, a phase separator, and a fresh food and freezer expansion device and evaporator, the fresh food and freezer evaporators disposed within the respective fresh food and freezer compartments. The condenser is in serial fluid communication downstream from the compressor and the fresh food expansion device in serial fluid communication downstream from the condenser. The fresh food evaporator is in serial downstream fluid communication from the fresh food expansion device and upstream serial fluid communication from the phase separator. A liquid phase output of the phase separator is in serial fluid communication upstream of the freezer expansion device and evaporator and a vapor phase output of the phase separator is in serial fluid communication upstream from the compressor via the fluid passageway.

A further aspect of the disclosed embodiments relates to a reciprocating refrigerant compressor system. The system includes a compression chamber circumscribed by a chamber wall, a piston, at least one aperture in the chamber wall, and at least one actuator. The piston is disposed within the compression chamber for reciprocating movement between a first position and a second position for compressing refrigerant received in the chamber. The at least one aperture is disposed between the first position and the second position and defines a fluid passageway through the chamber wall. The actuator is operative to selectively, at least partially, close the at least one aperture to change the effective cooling capacity of the compressor system.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
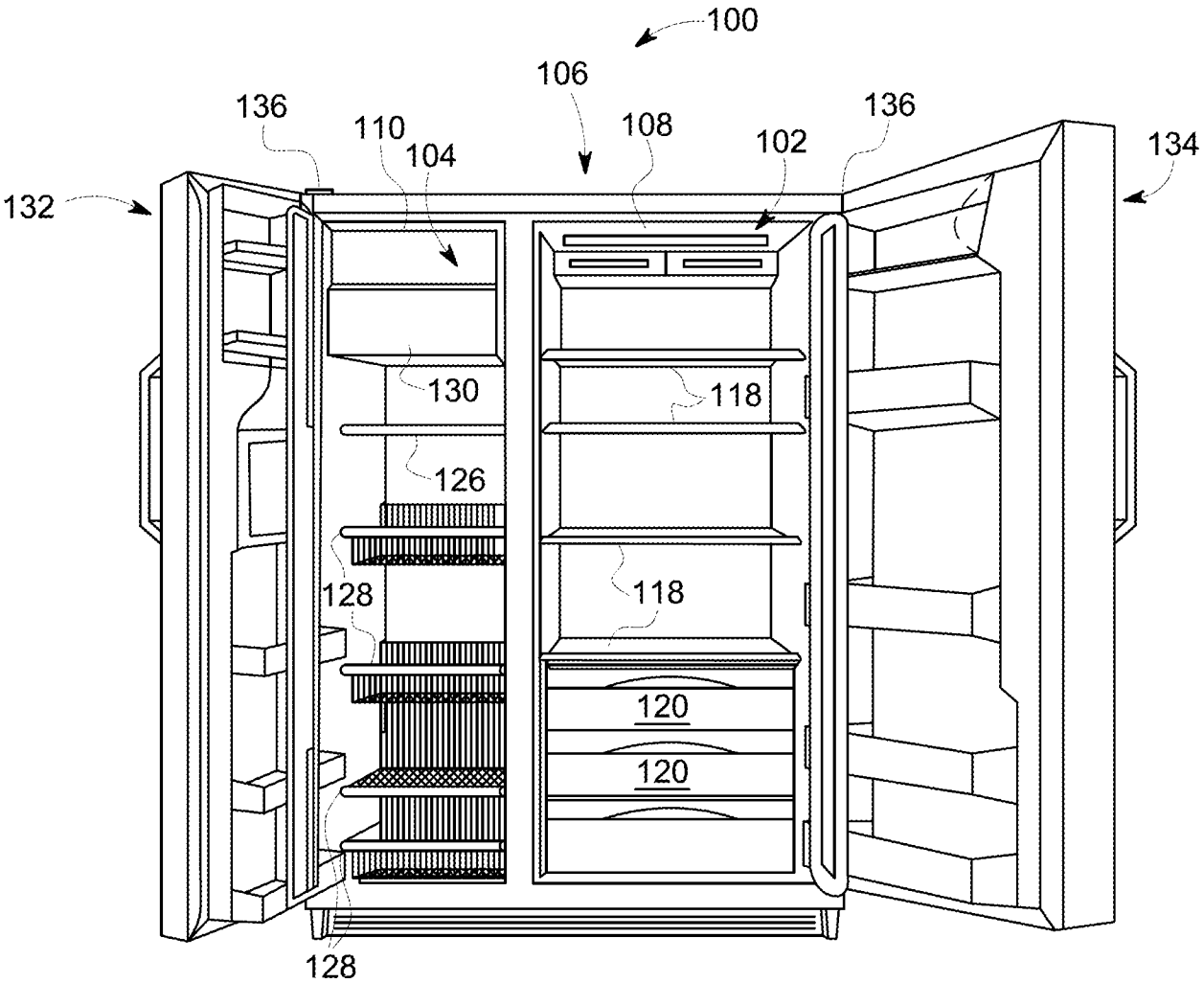
FIG. 1 illustrates front perspective view of an appliance in accordance with an embodiment of the present disclosure.

FIG. 1 illustrates an appliance 100, such as a side by side refrigerator 100, in which aspects of the present disclosure may be practiced. Aspects of the refrigerator 100 disclosed herein generally include a compressor with a compression chamber and a piston disposed within the chamber for reciprocal motion between a first position and a second position. One or more apertures are provided in the wall of the chamber between the first and second positions, each aperture defining a fluid passageway through the chamber wall. An actuator is provided to selectively partially or fully open or close the fluid passageways to vary a capacity and pressure ratio of the compressor based upon one or more conditions external to the compressor system such as for example the cooling demand of the refrigerator. In an embodiment, the fluid passageways are normally open, reducing an amount of starting torque for the compressor and allowing use of a motor sized to eliminate excess torque capacity and enhance efficient operation of the compressor. The actuator may be responsive to conditions external to the compressor, such as ambient temperature and refrigerator compartment temperature, to optimize refrigerator operation. In one embodiment, selection of a cooling capacity may be driven by the refrigerator 100 sensing a demand of the cooling required and commanding the compressor to provide an appropriate cooling capacity and pressure ratio of the compressor. In another embodiment, the compressor may determine its power consumption and select the cooling capacity and pressure ratio to maintain operation within a specified power consumption range.

As is shown in FIG. 1, refrigerator 100 includes a fresh food storage compartment 102 and a freezer storage compartment 104. Fresh food storage compartment 102 and freezer compartment 104 are arranged side-by-side in an outer case 106 with inner liners 108 and 110. Shelves 118 and slide-out drawers 120 are typically provided in fresh food compartment 102 to support items being stored therein. A shelf 126 and wire baskets 128 are also provided in freezer compartment 104. In addition, an ice maker 130 may be provided in freezer compartment 104. A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment 102, 104.

Figure 2:
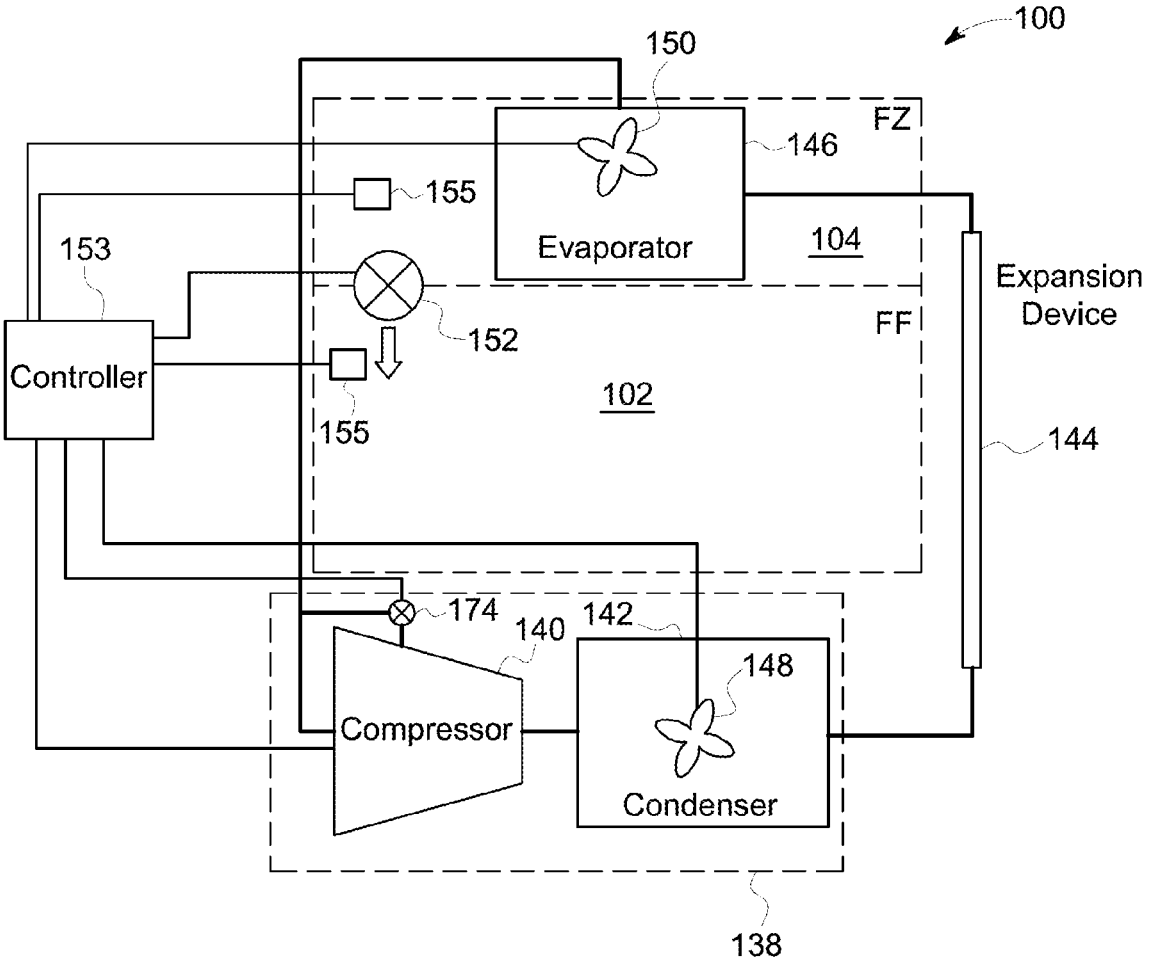
FIG. 2 depicts a schematic diagram of a single-evaporator refrigerator in accordance with an embodiment of the present disclosure.

FIG. 2 depicts a schematic diagram of an embodiment of a single-evaporator refrigerator 100, as may be appreciated by one of skill in the art. In one embodiment, refrigerator 100 includes a machinery compartment 138 that at least partially contains components for executing a vapor compression cycle for cooling air inside fresh food compartment 102 and freezer compartment 104 by transferring heat from the inside of refrigerator 100 and rejecting the heat to the outside of refrigerator 100. The components include a compressor 140, a condenser 142, an expansion device 144 and an evaporator 146 connected in series and charged with a fluid refrigerant. The evaporator 146 is a type of heat exchanger which transfers heat from air passing over the evaporator 146 to a refrigerant flowing through the evaporator 146, thereby causing the refrigerant to vaporize and cool the evaporator 146 surface, while heat is rejected in the condenser 142. Heat transfer through the condenser 142 and evaporator 146 may be enhanced via fans 148, 150, respectively. The cooled air is used to refrigerate one or more refrigerator 100 compartments 102, 104 via one or more circulation fans and/or dampers 152. A controller 153 is in signal communication with the compressor 140, fans 148, 150, and a temperature sensor 155 disposed within at least one of the compartments 102, 104, to control the temperature therein. The controller 153 generally includes one or more processors that are operable to control the temperature, as is further described herein. In one embodiment, the controller 153 is comprised of machine-readable instructions that are executable by a processing device. Collectively, the vapor compression cycle components 140, 142, 144, 146, are referred to herein as a sealed system. The construction of the sealed system, associated fans 148, 150, compartments 102, 104, and controller 153, is understood by one of skill in the art and therefore not described in detail herein. In an embodiment, the controller 153 is responsive to an environmental condition external to the sealed system, such as a temperature within one of the compartments 102, 104, ambient temperature surrounding the refrigerator 100, or selection of an operational mode, such as ice making or accelerated cooling, for example, to control operation of the sealed system and associated fans 148, 150 as described further herein to force cold air through the refrigerator 100 and maintain desired operational parameters. The controller 153 may employ various temperature maintenance arrangements that would be appreciated by one of skill in the art, such as a simplified two-step thermostat, multiple temperature measurements within a compartment 102, 104, and proportional-integral-derivative (PID) control scheme.

Figure 3:
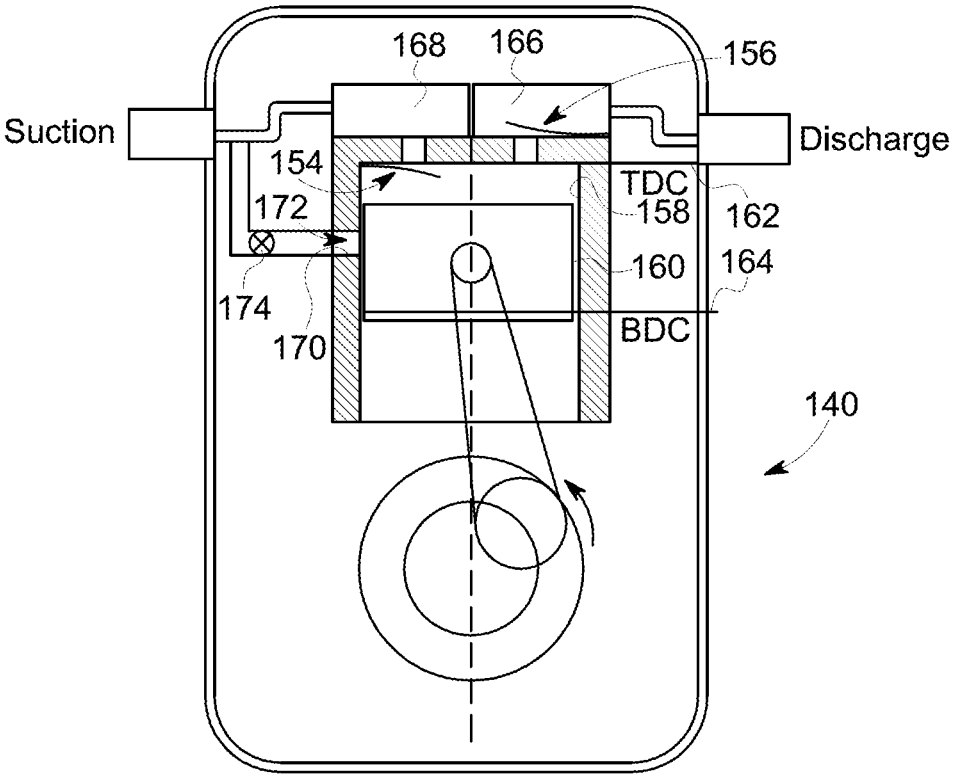
FIG. 3 depicts a cross section schematic diagram of a variable capacity reciprocating refrigeration compressor in accordance with an embodiment of the present disclosure.

FIG. 3 depicts a schematic diagram of an embodiment of a variable capacity reciprocating refrigeration compressor 140. Compressor 140 includes suction valve 154 and discharge valve 156 for controlling refrigerant flow into and out of a compression chamber including a cylinder 158 of the compressor 140. A piston 160 is configured for reciprocating movement between a first position which is the bottom dead center (BDC) and a second position which is the top dead center (TDC) of the piston 160 stroke within the chamber. As piston 160 travels from the TDC position 162 to the BDC position 164, the cylinder 158 fills with refrigerant. When the piston 160 changes direction and travels from BDC 164 to TDC 162 the suction valve 154 closes and refrigerant gas is compressed until it exceeds a discharge pressure of the refrigerant within a discharge plenum 166 and discharge valve 156 spring force. Refrigerant gas is then discharged through the valve 156 into plenum 166 for the remainder of piston 160 travel to TDC 162. When the piston 160 reaches TDC 162 and begins to move toward BDC 164, a small amount of high pressure refrigerant remains and expands to a pressure of the refrigerant in a suction plenum 168. When the piston 160 moves enough to overcome a force of the suction valve 154, the suction valve 154 opens, filling the cylinder 158 with gaseous refrigerant at the suction pressure.

The wall of cylinder 158 includes at least one fluid passageway 170. The fluid passageway 170 is defined by at least one aperture or opening 172, such as a substantially radial aperture, disposed between TDC and BDC. An actuator 174 (best seen with reference to FIGS. 14-17, and represented schematically as a valve in FIGS. 2, 3, 6, and 8) is responsive to controller 153 (FIG. 2) to selectively open and close the aperture 172. Although for the purposes of the description herein only one aperture will be generally referred to, in alternate embodiments, a fluid passageway 170 can include multiple apertures. An illustrative example of a fluid passageway having multiple apertures is a shower head. In one embodiment, each aperture 172 can be associated with a corresponding actuator 174. Alternatively, a single actuator 174 can be used to open and closes a plurality of apertures 172.

In response to the actuator 174 closing the aperture 172, and thus the fluid passageway 170, repeated reciprocal motion of the piston 160 between BDC 164 and TDC 162 results in suction and compression of the refrigerant gas for the entire stroke of the piston 160. This provides a high cooling capacity and pressure ratio. Specifically, pressure ratio is defined as the quotient of the pressure in cylinder 158 with the piston 160 at TDC 162 and the pressure in cylinder 158 with the piston 160 at BDC 164 (i.e., TDC Pressure/BDC Pressure), while capacity is defined as the difference between the volume of cylinder 158 with the piston 160 at BDC 164 and the volume of cylinder 158 with the piston 160 at TDC 162 (i.e. BDC Volume−TDC Volume).

In response to the actuator 174 opening the aperture 172, and thus the fluid passageway 170, suction of the refrigerant (while the piston 160 travels from TDC 162 to BDC 164) occurs through the suction valve 154 until the piston 160 passes the open fluid passageway 170. As the piston 160 continues to travel from the open fluid passageway 170 to BDC 164, the suction valve 154 will be closed and the open fluid passageway 170 will allow refrigerant gas to continue to fill the cylinder 158. After the piston 160 reaches BDC 164 and reverses direction to approach TDC 162, the open fluid passageway 170 will delay the compression of refrigerant until the piston 160 passes the position of the fluid passageway 170. The capacity and pressure ratio of the compressor 140 are reduced while the piston 160 travels from BDC 164 to the position of the fluid passageway 170. That is, in response to the actuator 174 opening the fluid passageway 170, refrigerant is pumped back out of the cylinder 158 through the open fluid passageway 170 until the piston 160 covers the fluid passageway 170. Therefore, if a top surface of the fluid passageway 170 is disposed at a position X and the aperture 172 is open, pressure ratio is defined as the quotient of the pressure in cylinder 158 with the piston 160 at TDC 162 and the pressure in cylinder 158 with the piston 160 at position X (i.e. (TDC pressure)/(X pressure)), while capacity is defined as the difference between the volume of cylinder 158 with the piston 160 at X and the volume of cylinder 158 with the piston 160 at TDC 162 (i.e. (X Volume)−(TDC Volume)). It will be appreciated that in response to the one or more apertures 172 being open, the pressure ratio and capacity of the compressor 140 are reduced. Accordingly, an amount of torque to initiate operation of the compressor 140 is also reduced. Such reduction in starting torque allows for a corresponding reduction in required motor design torque capacity. Stated alternatively, an efficiency island (a set of concentric ovals or islands about a specific speed/torque plot) of a motor for a variable capacity compressor can be changed relative to a compressor having a single, fixed capacity. Use of the variable capacity compressor described herein allows a shift in the motor's efficiency island toward operation during low demand.

Capacity change of the compressor 140, in response to the fluid passageway 170 being opened is in direct, linear relation to location of the fluid passageway 170 between BDC 164 and TDC 162. Placement of the fluid passageway 170 proximate to BDC 164 results in a relatively small change in capacity and pressure ratio in response to the one or more apertures 172 being opened by actuator 174. Alternatively, placement of the fluid passageway 170 proximate to TDC 162 provides a relatively large change (reduction) in capacity and pressure ratio of the compressor 140. Different fluid passageway 170 positions throughout the stroke can be selected for different applications. Use of the actuator 174 to open and closes aperture(s) 172 to vary compressor 140 capacity as described herein allows the compressor 140 to operate uninterrupted during a change in cooling capacity, without any need to stop and restart the compressor 140.

Figure 4B:
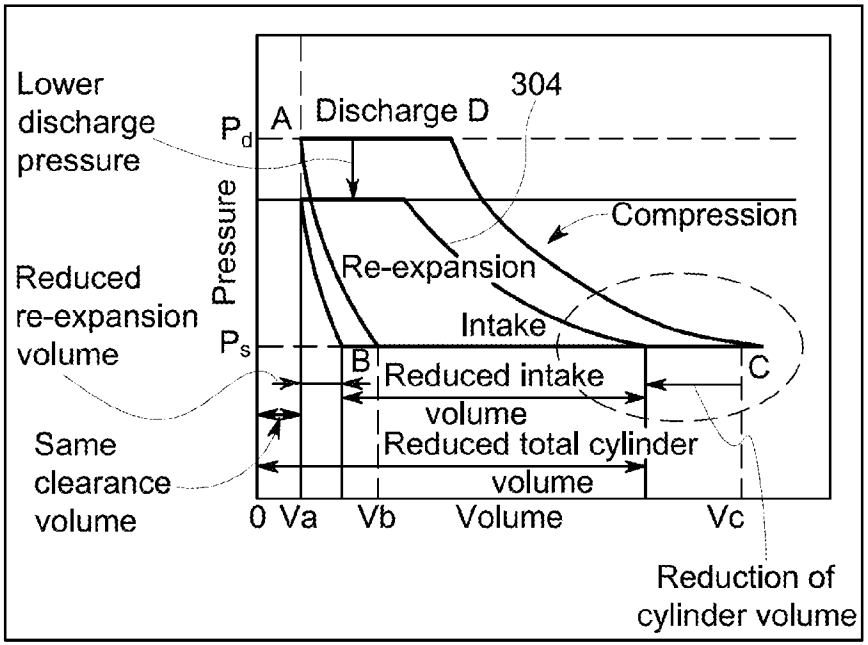
FIGS. 4(*a*) and 4(*b*) depict two pressure-volume (PV) diagrams corresponding to operation of the variable capacity compressor of FIG. 3 in accordance with an embodiment of the present disclosure.
Figure 4A:
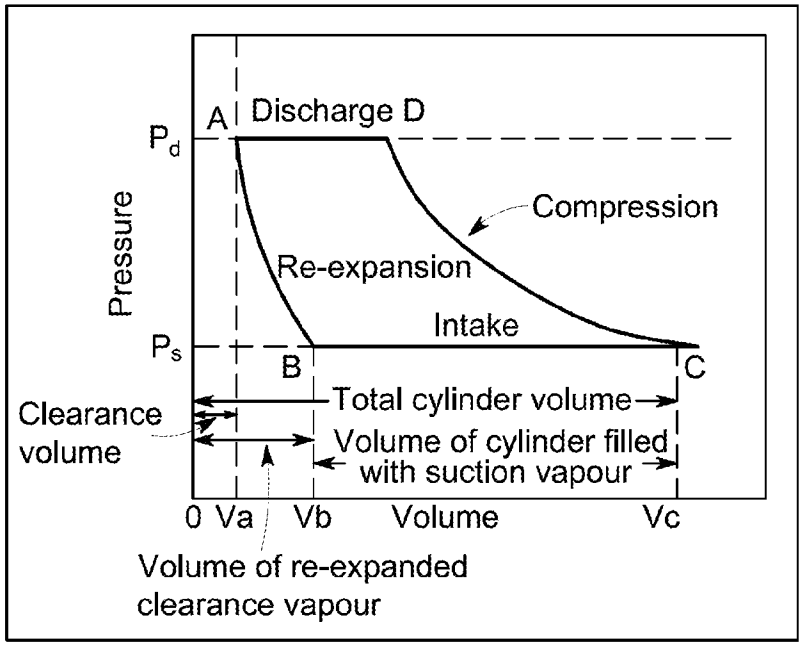

FIGS. 4(*a*) and 4(*b*) depict two pressure-volume (PV) diagrams 300, 302 corresponding to operation of an exemplary embodiment of a variable capacity compressor 140. PV diagram 300 of FIG. 4(*a*) corresponds to operation of the compressor 140 with the fluid passageway 170 closed. Closure of the fluid passageway 170 provides 100% capacity and pressure ratio, with maximum discharge pressure, compression work, and compressor power consumption.

PV diagram 302 of FIG. 4(*b*) includes the diagram of operation with the fluid passageway 170 closed as depicted by PV diagram 300, with an overlay 304 depicting operation of the compressor 140 with the fluid passageway 170 opened. With the fluid passageway 170 open, the compression process is delayed. The delayed compression reduces the compressor 140 capacity. The discharge pressure developed in the cylinder 158 (and corresponding pressure ratio), over compression, overall compression, vapor re-expansion, compressor capacity, compression work, and power consumption, are all reduced.

Figure 5A:
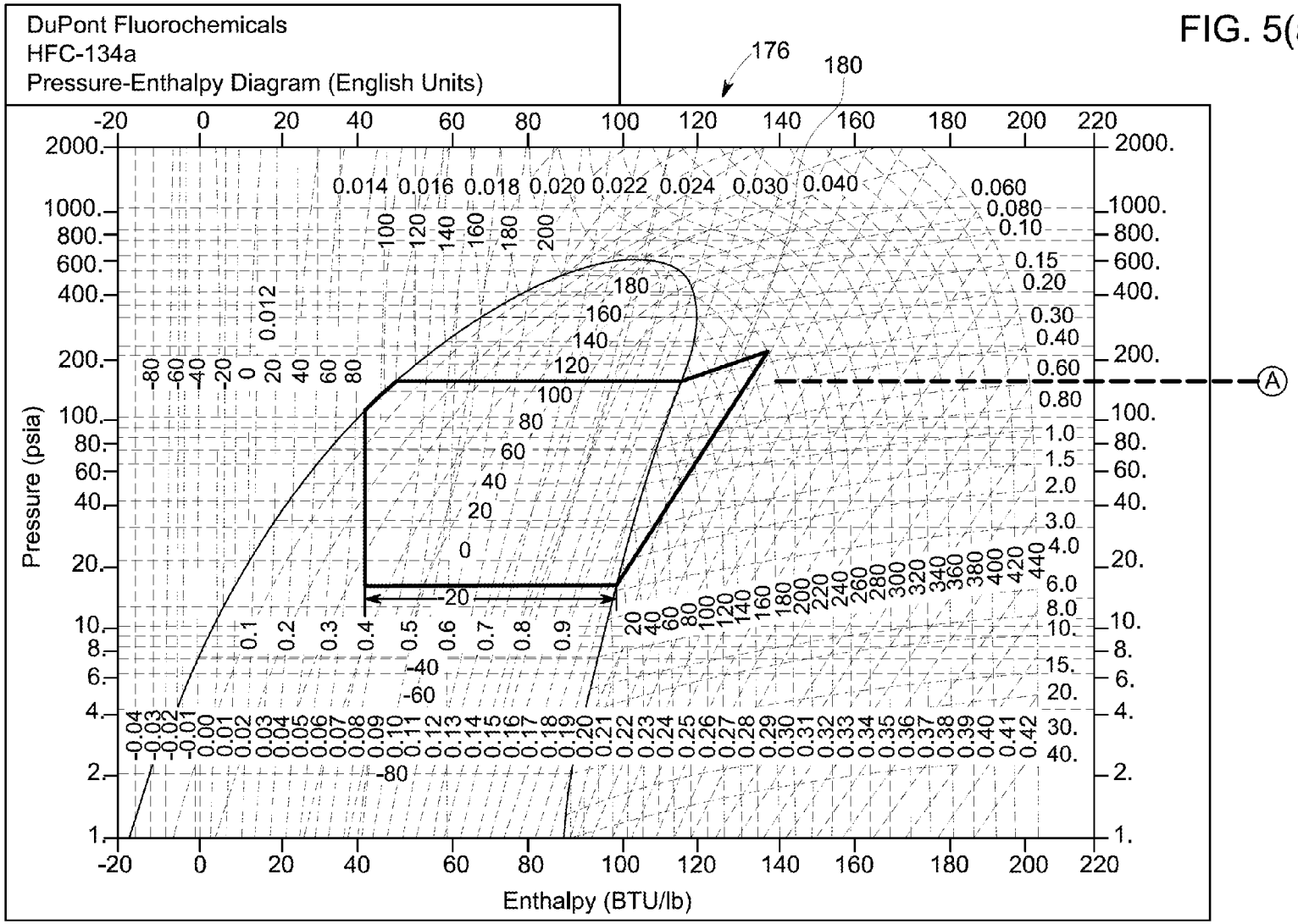
FIGS. 5(*a*) and 5(*b*) depict two pressure-enthalpy (Ph) diagrams corresponding to operation of the single-evaporator refrigerator of FIG. 2 in accordance with an embodiment of the present disclosure.
Figure 5B:
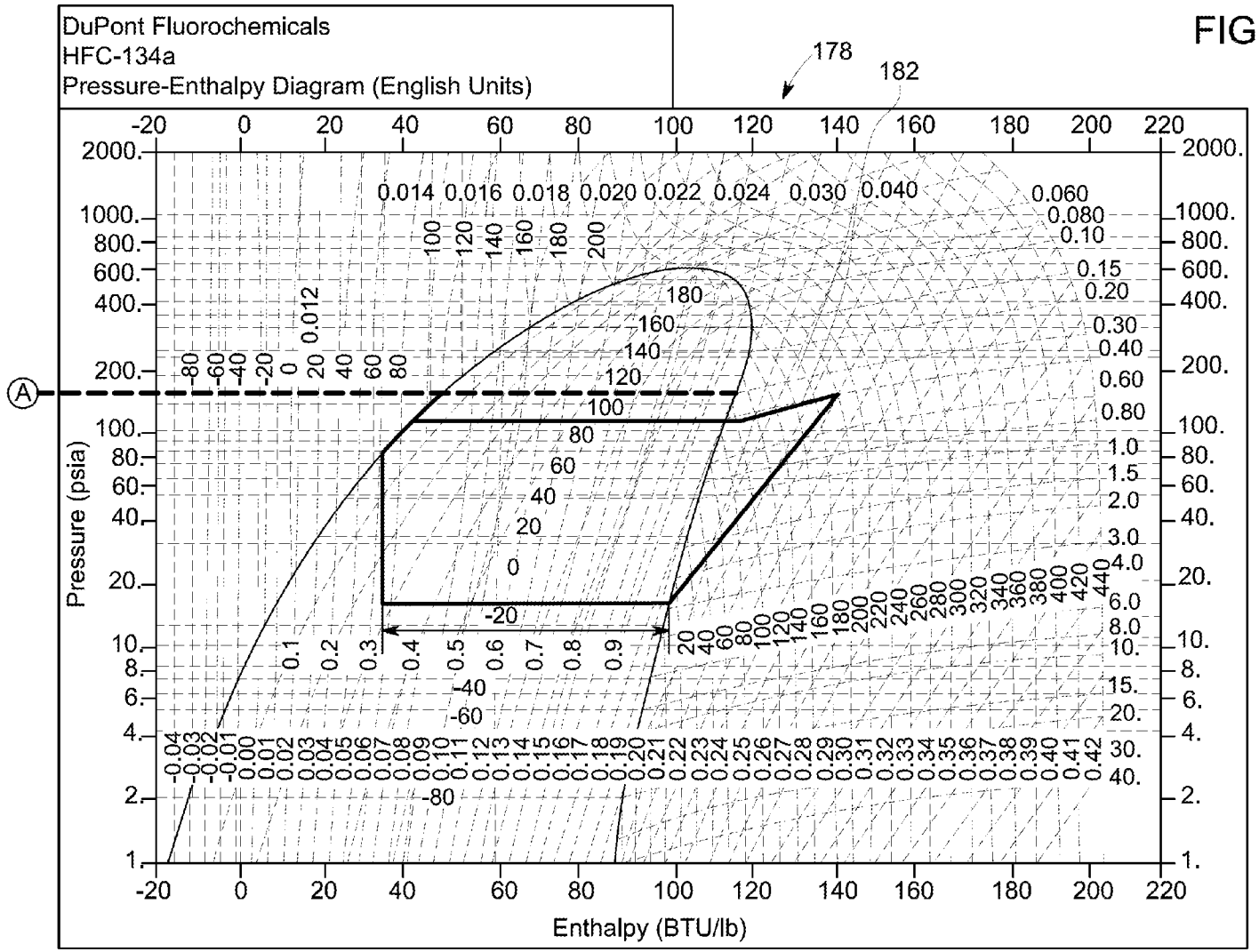

In one embodiment, placement of the fluid passageway 170 proximate BDC 164 provides a relatively small change in capacity and pressure ratio, and is contemplated to reduce complications associated with high efficiency refrigerators, such as the single evaporator refrigerator 100 as shown in FIG. 2. FIGS. 5(*a*) and 5(*b*) depict two pressure-enthalpy (Ph) diagrams 176, 178 corresponding to an exemplary embodiment of a compressor 140 used in a single-evaporator refrigerator 100, as is shown in FIG. 2. The Ph diagram 176 of FIG. 5(*a*) illustrates an exemplary vapor-compression refrigeration cycle 180 in accordance with the fluid passageway 170 (best seen with reference to FIG. 3) being closed. Full capacity operation of compressor 140 at 90 degree Fahrenheit ambient temperature testing, as depicted by Ph diagram 176, is contemplated to result in a pressure ratio of approximately 9, with a refrigerant pressure through the evaporator 146 of approximately 16.5 pounds per square inch absolute (psia) and through the condenser 142 of approximately 150 psia. The Ph diagram 178 of FIG. 5(*b*) illustrates an exemplary vapor-compression refrigeration cycle 182 in accordance with the fluid passageway 170 being open and disposed approximately 25% of the stroke distance from BDC 164 toward TDC 162. (This is an example of a low ambient, low demand operating point.) Ph diagram 178 depicts operation of the compressor 140 at 75 degrees Fahrenheit ambient temperature, with the fluid passageway 170 open, and is contemplated to provide a modulation step with a 25% capacity reduction and a pressure ratio of approximately 7, with a refrigerant pressure through the evaporator 146 of approximately 16.5 psia and through the condenser 142 of approximately 120 psia.

In an embodiment of the single evaporator refrigerator 100, the controller 153 may be responsive to a high ambient temperature external to the refrigerator to close the fluid passageway 170, thereby operating the variable capacity compressor 140 with a high pressure ratio and high capacity mode. The controller 153 may also be responsive to a high demand, such an elevation of temperature within one of the compartments 102, 104 above a predetermined threshold, an accelerated cooling mode, or use of an automatic ice maker, to close the fluid passageway 170 and operate the variable capacity compressor 140 with the high pressure ratio and high capacity mode. This high pressure ratio and capacity mode provides increased capacity compared to a single capacity compressor and better pressure matching, resulting in faster cooling. The controller 153 is likewise responsive to a low ambient temperature, low demand, or an approach of temperature within one of the compartments 102, 104 to a desired set point, to open the fluid passageway 170 and operate the variable capacity compressor 140 with a lowered pressure ratio and capacity. This lower pressure ratio and low capacity mode provides better pressure matching and energy and temperature control compared to a single capacity compressor.

Figure 6:
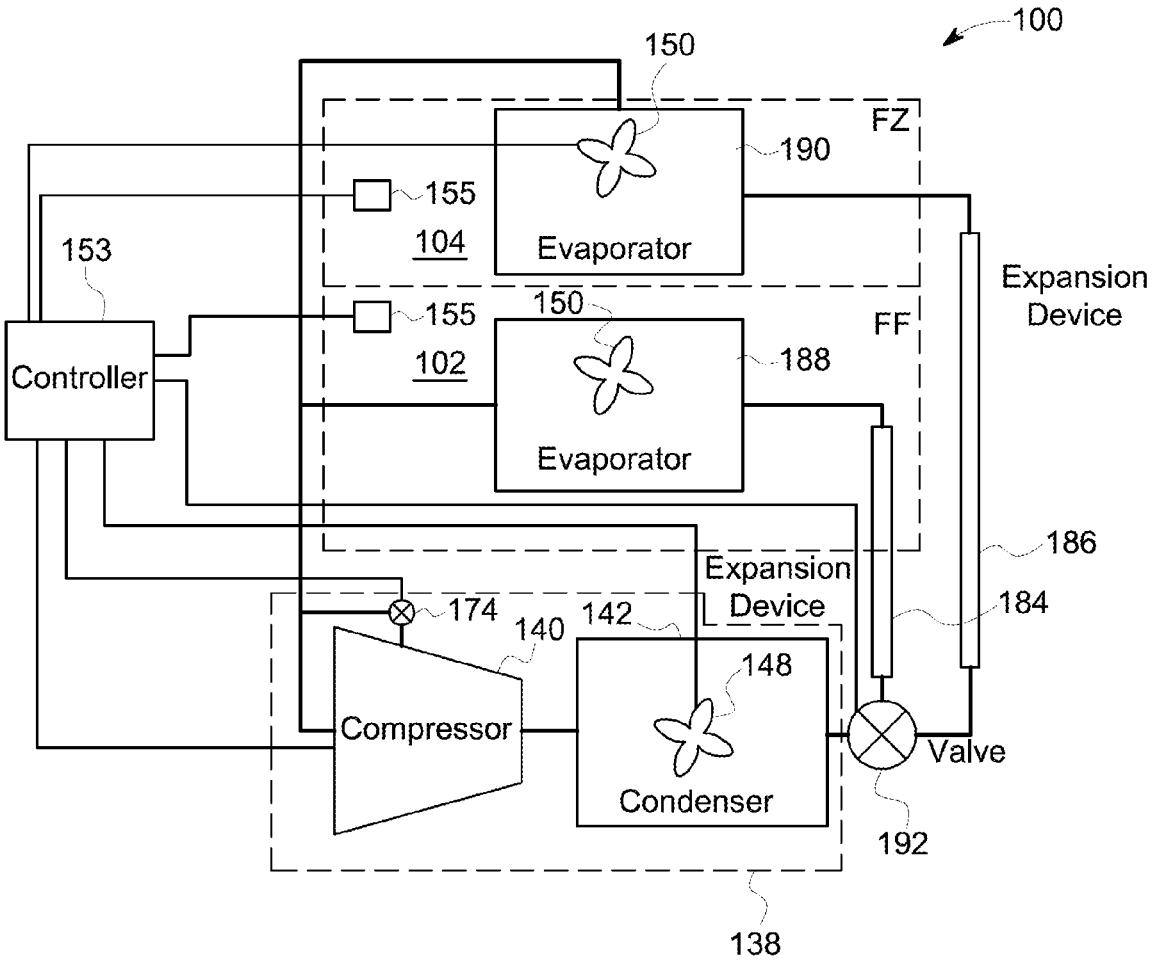
FIG. 6 depicts a schematic diagram of a dual-evaporator refrigerator in accordance with an embodiment of the present disclosure.

FIG. 6 depicts a schematic diagram of one embodiment of the refrigerator 100 having a dual evaporator design. The dual evaporator refrigerator 100 includes the machinery compartment 138 that at least partially contains components for executing a vapor compression cycle for cooling air inside fresh food compartment 102 and freezer compartment 104. The components of the dual evaporator refrigerator 100 include a compressor 140 and a condenser 142 in serial fluid communication with one another. Fresh food and freezer compartment expansion devices 184, 186 are in parallel fluid communication with the condenser 142 through a diverter valve 192. Fresh food and freezer evaporators 188, 190, respectively, are in serial fluid communication downstream of their corresponding expansion devices 184, 186 and in upstream parallel fluid communication with the compressor 140. The valve 192 selectively directs the refrigerant to one or both of the expansion devices 184, 186 and corresponding evaporator 188, 190. Based upon the cooling needs of the individual compartments 102, 104, the valve 192 is responsive to the controller 153 to direct the refrigerant through the appropriate expansion device 184, 186 to the corresponding evaporator 188, 190. As described above, the controller 153 is in signal communication with the temperature sensor 155 disposed within at least one of the compartments 102, 104, the compressor 140, fans 148, 150, actuator 174, and valve 192 to control the temperature of the refrigerator compartments 102, 104. Collectively, the vapor compression cycle components 140, 142, 184, 186, 188, 190, 192 are referred to herein as a sealed system. The construction of the sealed system, associated fans 148, 150, compartments 102, 104, and controller 153, is understood by one of skill in the art and therefore not described in detail herein. In one embodiment, the controller 153 is responsive to an environmental condition external to the sealed system, such as a temperature within one of the compartments 102, 104 for example, to control operation of the sealed system and associated fans 148, 150 as described further herein, to force cold air through the refrigerator 100.

Figure 7A:
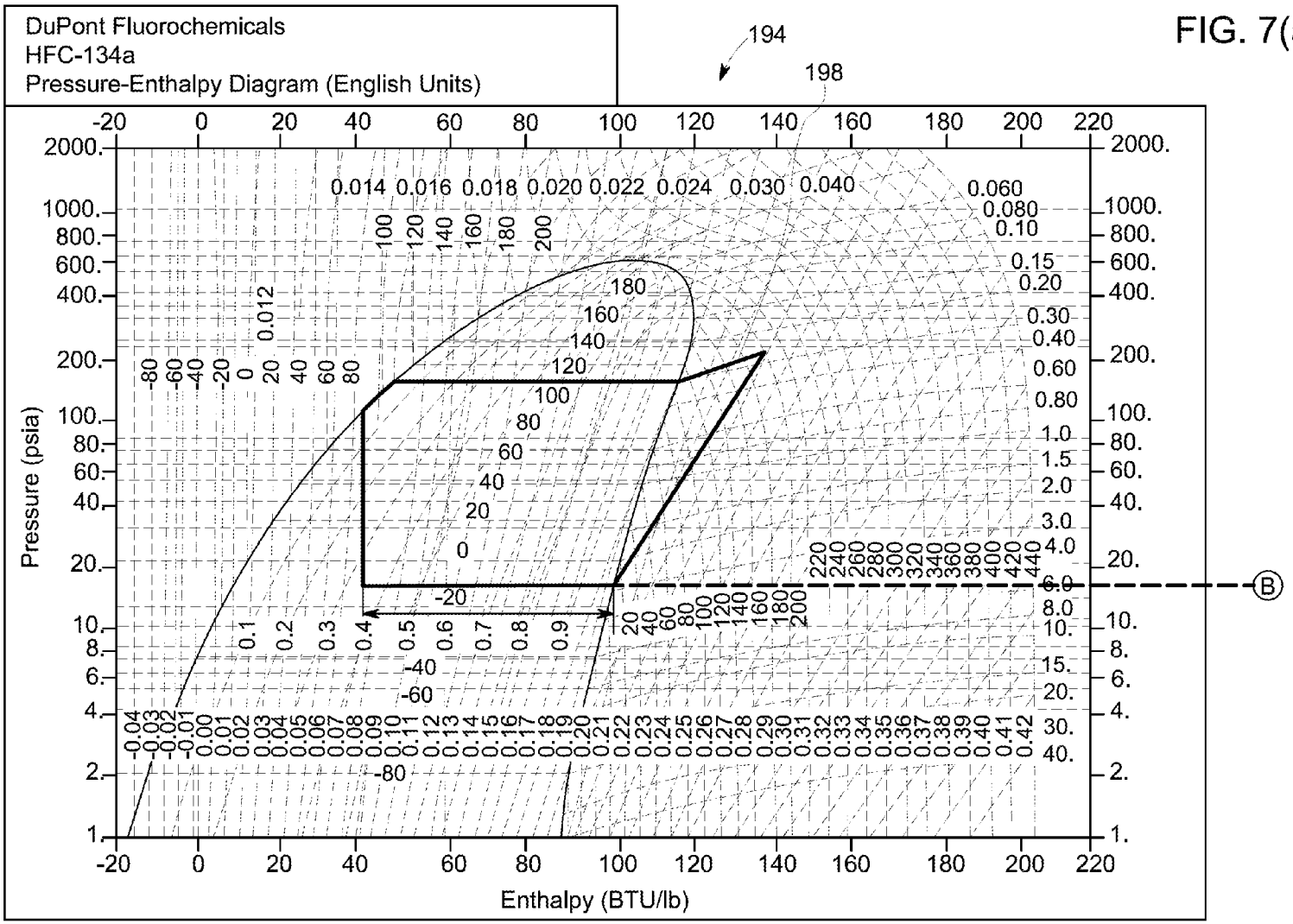
FIGS. 7(*a*) and 7(*b*) depict two pressure-enthalpy (Ph) diagrams corresponding to operation of the dual-evaporator refrigerator of FIG. 6 in accordance with an embodiment of the present disclosure.
Figure 7B:
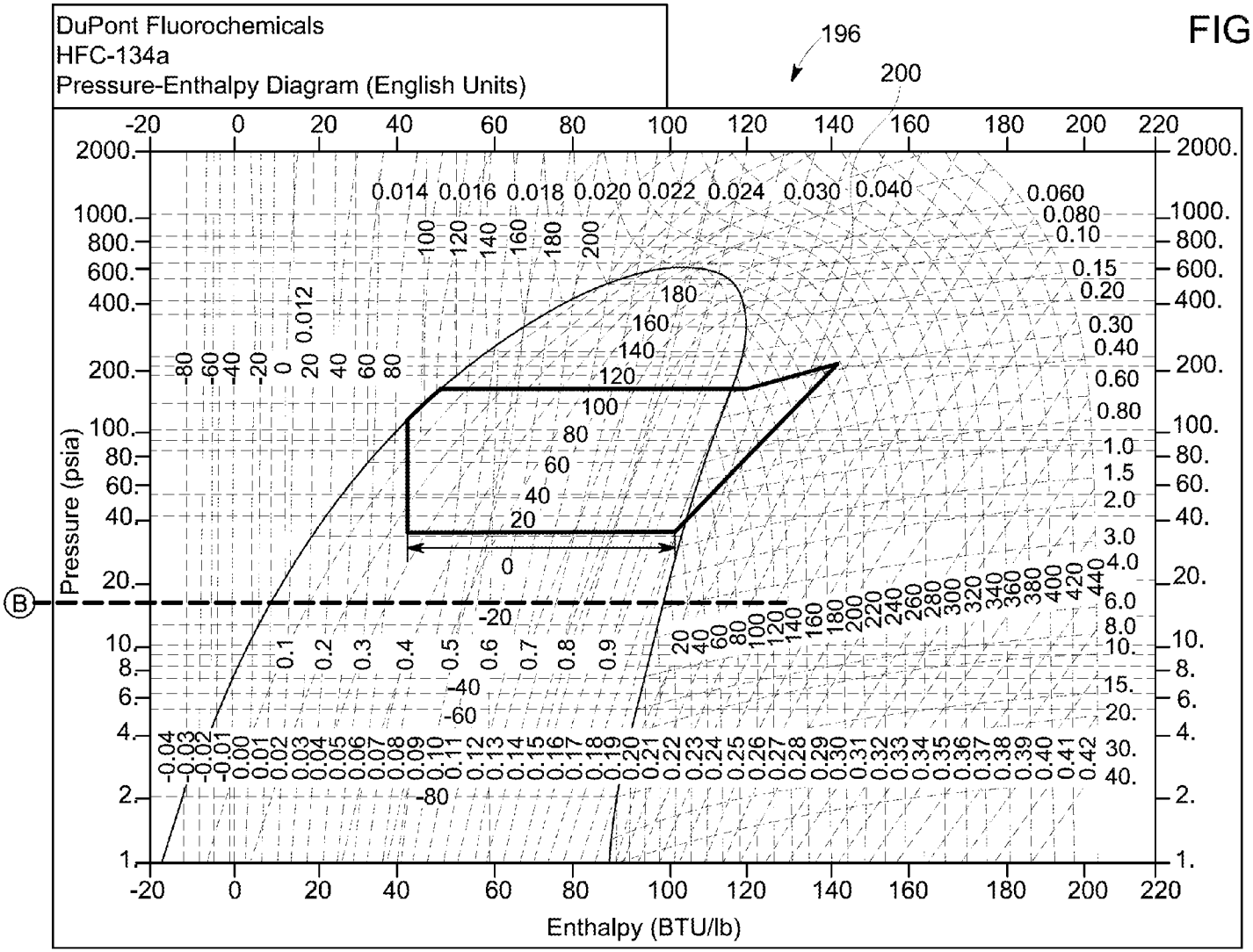

In an embodiment, placement of the fluid passageway 170 approximately midway between BDC 164 and TDC 162 provides an approximate halving of the capacity and pressure ratio, and is contemplated to provide sufficient capacity for use with multiple evaporators, such as with the dual evaporator refrigerator 100 shown in FIG. 6. FIGS. 7(*a*) and 7(*b*) depict two Ph diagrams 194, 196 corresponding to an exemplary embodiment of a compressor 140 used in the dual-evaporator refrigerator 100 shown in FIG. 6. With reference to FIGS. 3, 6, and 7(*a*), the Ph diagram 194 illustrates an exemplary vapor-compression refrigeration cycle 198 in accordance with the fluid passageway 170 being closed and the valve 192 diverting the refrigerant through the expansion device 186 and the evaporator 190. Ph diagram 194 depicts full capacity operation of compressor 140 at approximately 90 degree Fahrenheit ambient temperature testing, and is contemplated to result in a pressure ratio of approximately 9, with a refrigerant pressure through the freezer evaporator 190 of approximately 16.5 pounds per square inch absolute (psia) and through the condenser 142 of approximately 150 psia. The Ph diagram 196 of FIG. 7(*b*) illustrates an exemplary vapor-compression refrigeration cycle 200 in accordance with the fluid passageway 170 being open and disposed approximately 50% of the stroke distance from BDC 164 toward TDC 162 and the valve 192 diverting the refrigerant through the expansion device 184 and the evaporator 188. Operation of the compressor 140 at approximately 90 degree Fahrenheit ambient temperature with the fluid passageway 170 open, as depicted by Ph diagram 196, is contemplated to provide a modulation step with an approximately 50% capacity reduction and a pressure ratio of approximately 4, with a refrigerant pressure through the fresh food evaporator 188 of approximately 34.5 psia and through the condenser 142 of approximately 150 psia. Use of the variable capacity compressor 140 provides an ability to better match the cooling capacity and pressure ratio of each respective compartment 102, 104, such as full capacity and a pressure ratio of approximately 9 for the freezer compartment 104 and approximately 50% capacity and a pressure ratio of 4 for the fresh food compartment 102. Thus, use of the variable capacity compressor 140 improves energy consumption, food preservation, pressure matching, and temperature control.

In an embodiment of the dual evaporator refrigerator 100, the controller 153 may be responsive to a high ambient temperature external to the refrigerator to close the fluid passageway 170, thereby operating the variable capacity compressor 140 with the high pressure ratio and high capacity mode. The controller 153 may also be responsive to a high demand, such as an elevation of temperature within one of the compartments 102, 104 above a predetermined threshold, and operation of the freezer compartment 104 evaporator 190 to close the fluid passageway 170 and operate the variable capacity compressor 140 with the high pressure ratio and high capacity mode. This high pressure ratio and capacity mode provides increased capacity compared to a single capacity compressor and better pressure matching for freezer compartment 104 cooling. The controller 153 is likewise responsive to a low ambient temperature, a low demand, an approach of temperature within one of the compartments 102, 104 to a desired set point, or operation of only the fresh food compartment 102 evaporator 188 to open the fluid passageway 170 and operate the variable capacity compressor 140 with a lowered pressure ratio and capacity. This lower pressure ratio and low capacity mode provides better energy, pressure matching, and temperature control for the fresh food compartment 102 compared to a single capacity compressor. While it is contemplated that full capacity operation would commonly be used with the freezer 104 or both compartment 102, 104, with low capacity operation contemplated for use with the fresh food compartment 102, there may be extreme conditions of fresh food compartment 102 temperature or cooling demand for a feature (such as an icemaker in the fresh food compartment 102) that could benefit from high capacity, high pressure ratio operation in a cooling mode associated with the fresh food compartment 102. Likewise at extremely low ambient conditions, the low capacity, low pressure ratio mode may satisfy cooling requirements for the freezer compartment 104.

Figure 8:
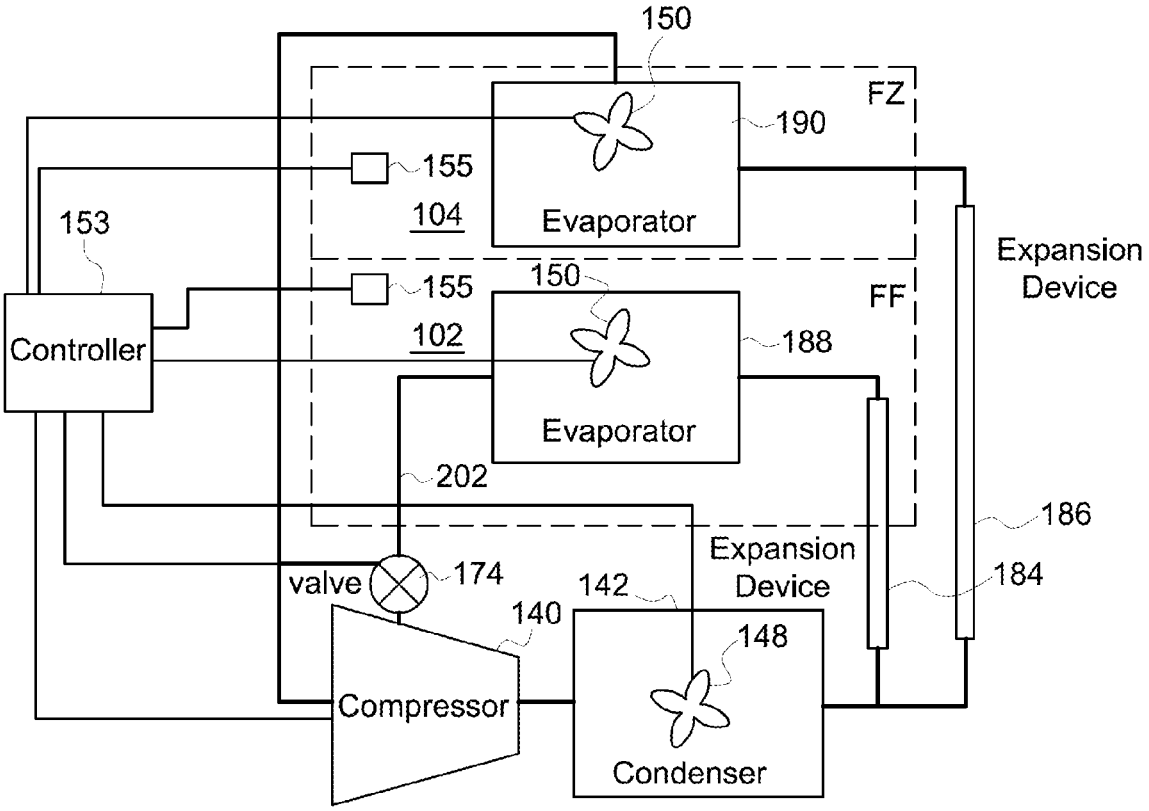
FIG. 8 depicts a schematic diagram of a dual-evaporator refrigerator in accordance with an embodiment of the present disclosure.

FIG. 8 depicts a schematic diagram of another embodiment of a refrigerator 100 having a dual evaporator design. Only distinctions in the configuration and operation of components from those of FIG. 6 will be described. The expansion devices 184, 186 are in downstream parallel fluid communication with the condenser 142. While the freezer evaporator 190 is in fluid communication with the suction plenum 168 (see FIG. 3), a suction line 202 of the fresh food compartment evaporator 188 is connected to the fluid passageway 170 and one or more apertures 172 via actuator 174. In response to the actuator 174 opening the one or more apertures 172, refrigerant will be provided to both the fresh food and freezer compartment evaporators 188, 190. In response to the actuator 174 closing the one or more apertures 172, refrigerant will be provided only to the freezer compartment evaporator 190.

Figure 9A:
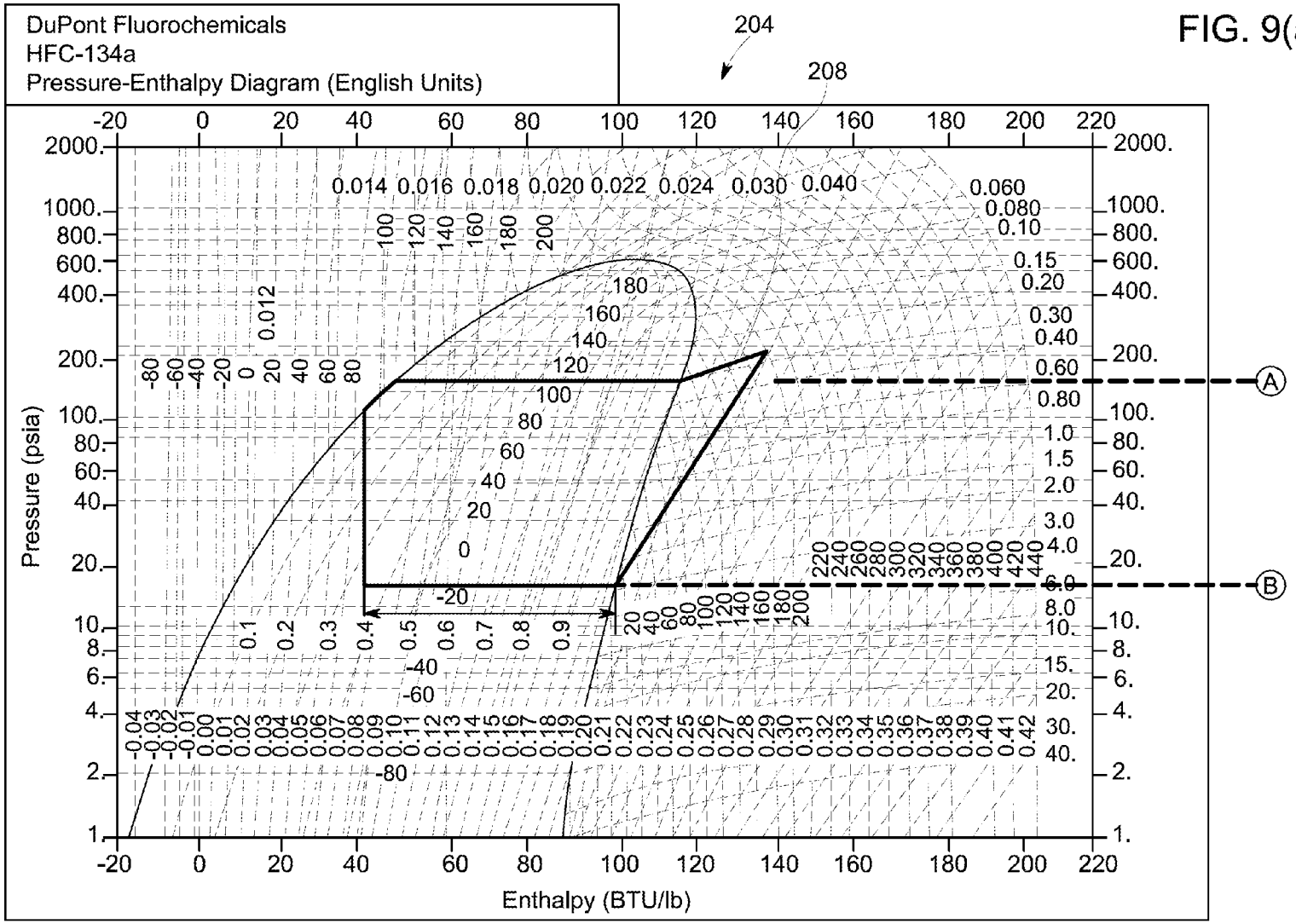
FIGS. 9(*a*) and 9(*b*) depict two pressure-enthalpy (Ph) diagrams corresponding to operation of the dual-evaporator refrigerator of FIG. 8 in accordance with an embodiment of the present disclosure.
Figure 9B:
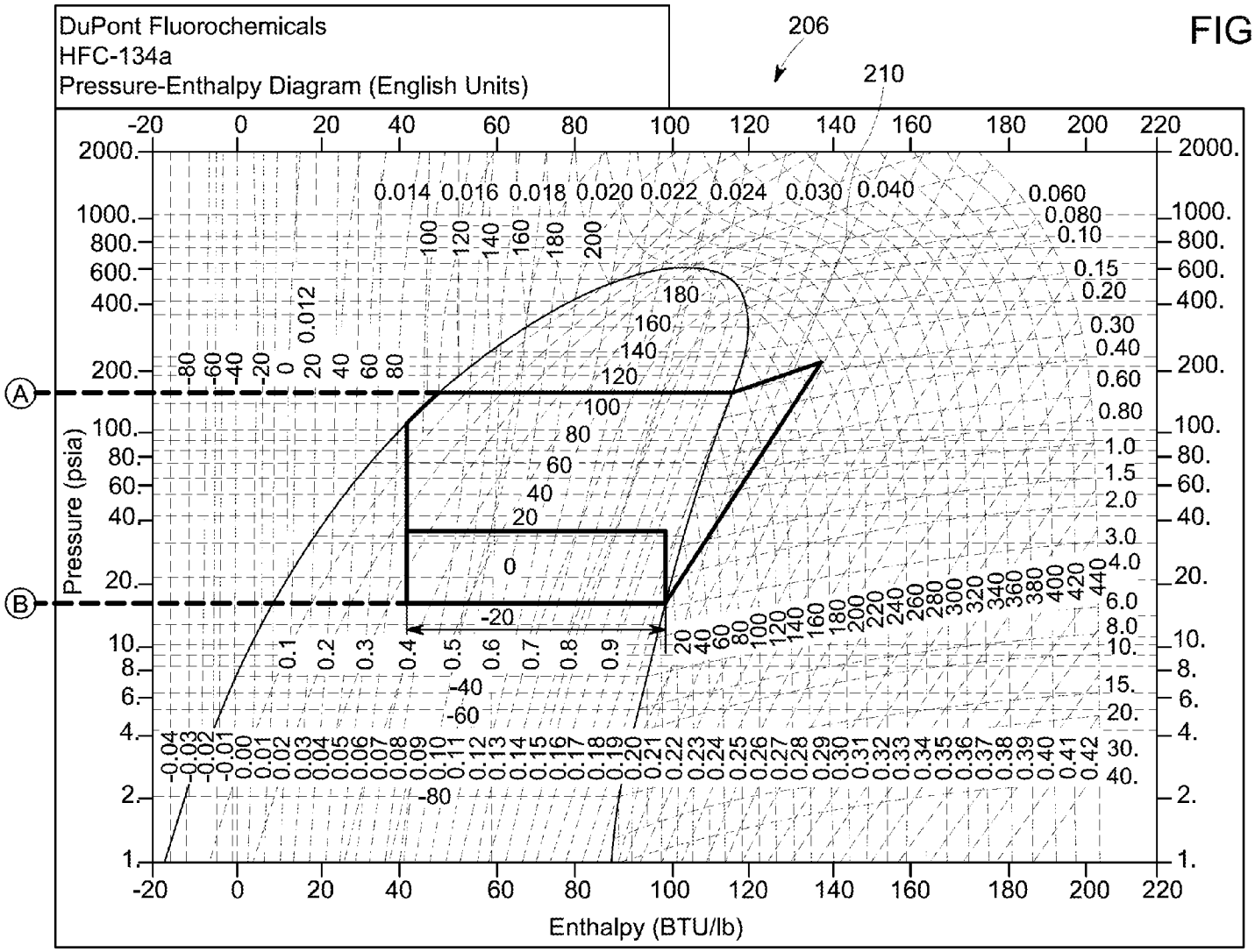

In one embodiment, placement of the fluid passageway 170 approximately midway between BDC 164 and TDC 162 provides a fresh food compartment 102 cooling capacity of approximately half of total cooling for the dual evaporator refrigerator 100 shown in FIG. 8. FIGS. 9(*a*) and 9(*b*) depict two Ph diagrams 204, 206 corresponding to an exemplary embodiment of a compressor 140 used in the dual evaporator refrigerator 100 of FIG. 8. With reference to FIGS. 3, 8 and 9(*a*), the Ph diagram 204 illustrates an exemplary vapor-compression refrigeration cycle 208 in accordance with the fluid passageway 170 being closed. With the fluid passageway 170 closed, the full cooling capacity of compressor 140 is provided exclusively to the freezer compartment 104. Ph diagram 204 represents operation at approximately 90 degree Fahrenheit ambient temperature testing, with a contemplated pressure ratio of approximately 9, refrigerant pressure through the evaporator 190 of approximately 16.5 pounds per square inch absolute (psia) and through the condenser 142 of approximately 150 psia. The Ph diagram 206 of FIG. 9(*b*) illustrates an exemplary vapor-compression refrigeration cycle 210 in accordance with the fluid passageway 170 being open and disposed at approximately 50% of the stroke distance from BDC 164 toward TDC 162. Operation of the compressor 140 at approximately 90 degree Fahrenheit ambient temperature with the fluid passageway 170 open, as depicted by Ph diagram 206, is contemplated to provide approximately 50% of the full cooling capacity to the fresh food compartment 102 with refrigerant pressure of approximately 16.5 psia through the freezer compartment evaporator 190, 34.5 psia through the fresh food compartment evaporator 188, and approximately 150 psia through the condenser 142.

In one embodiment of the dual evaporator refrigerator 100 design of FIG. 8, the controller 153 may be responsive to a high ambient temperature, greater cooling demand in the freezer compartment 104, special operation (such as an ice making or rapid cooling mode) or an approach of temperature within the fresh food compartment 102 to a desired set point, to close the fluid passageway 170, thereby providing the full cooling capacity of the compressor 140 to the freezer compartment 104. The controller 153 is responsive to a need for cooling within the fresh food compartment 102. An elevation of temperature within the fresh food compartment 102 above a predetermined threshold causes the fluid passageway 170 to open and thereby provide a portion of the cooling capacity of the compressor 140 to each of the fresh food compartment 102 and freezer compartment 104. The portion of the cooling capacity of the compressor 140 that will be provided to the fresh food compartment 102 is in direct relation the position of the fluid passageway 170, with increased distance from BDC toward TDC providing more cooling capacity to the fresh food compartment 102. In one embodiment, the actuator 174 may be partially activated to partially open one or more apertures 172, and thereby meter an amount of cooling capacity, less than that provided by the fluid passageway 170 being fully open, to the fresh food compartment 102. In another embodiment, a pulse width modulation (PWM) technique may be employed, such as to open the actuator 174 for about 1 minute out of 5 minutes to provide 20% cooling to the fresh food compartment 102 and to maintain an elevated operating temperature of the fresh food evaporator 188, while maintaining cooling of the freezer compartment 104 during the PWM operation of the actuator 174. In an embodiment where a fluid passageway 170 includes more than one aperture 172, each aperture 172 can be individually controlled to meter the amount of cooling capacity. For example, one or more apertures 172 can be open while one or more apertures 172 remain closed. Similarly, some apertures 172 can be partially opened while others remained closed or opened.

Figure 10:
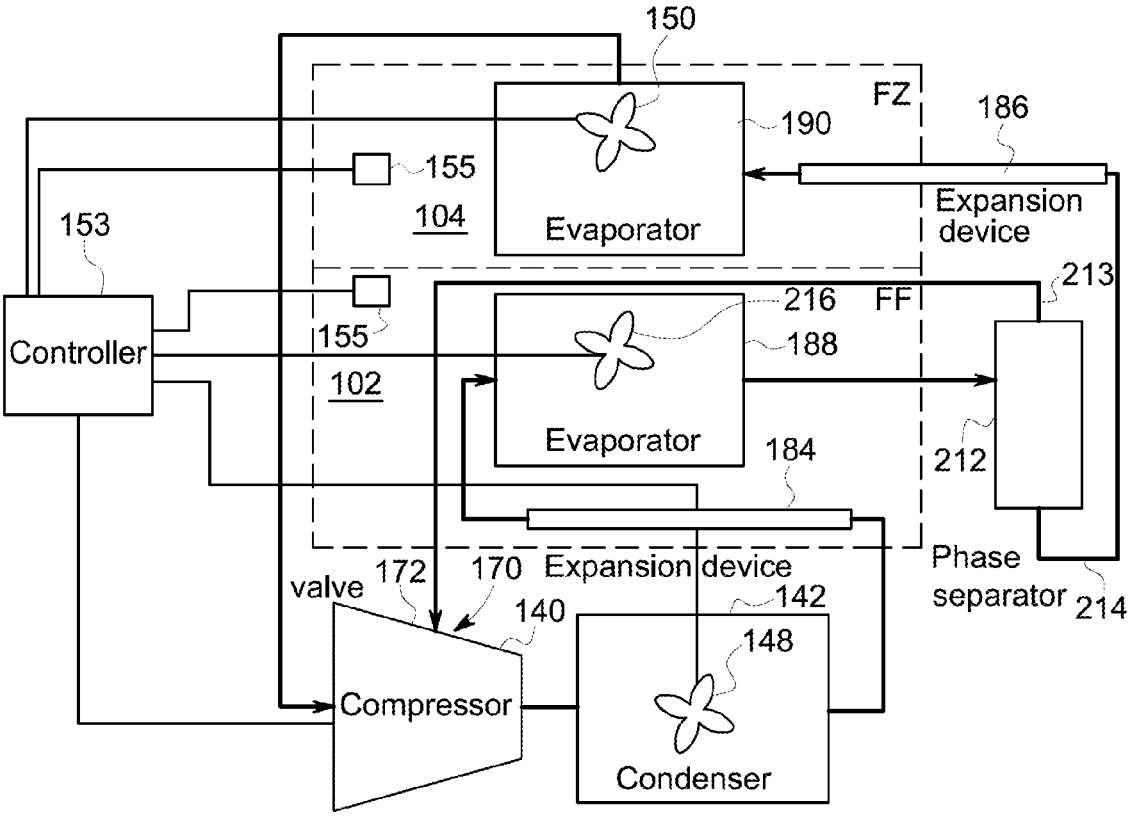
FIG. 10 depicts a schematic diagram of a dual-evaporator refrigerator in accordance with an embodiment of the present disclosure.

FIG. 10 depicts a schematic diagram of another embodiment of a refrigerator 100 having a dual evaporator design. Only distinctions in the configuration and operation of components from those of FIG. 6 will be described. The fresh food expansion device 184 and evaporator 188 are in downstream serial fluid communication with the condenser 142. A phase separator 212 is in downstream serial fluid communication with the fresh food evaporator 188. The phase separator 212 has a vapor output 213 and fluid output 214. The vapor output 213 represents the suction line of the fresh food evaporator 188 and is plumbed to the fluid passageway 170 of the compressor 140. Refrigerant that has absorbed heat from the fresh food evaporator 188 and become vaporized is returned to the compressor 140 via the vapor output or suction line 213. The fluid output 214 is in upstream serial fluid communication with the freezer expansion device 186 and evaporator 190. Liquid refrigerant that has not been vaporized in the fresh food evaporator 188 continues via the fluid output 214 to the freezer compartment evaporator 190. The freezer compartment evaporator 190 is in upstream serial fluid communication with the compressor 140. It will be appreciated that operation of the fresh food evaporator fan 216 while the compressor 140 is activated increases heat transfer into the refrigerant from the fresh food evaporator 188. Alternately, if a speed of the fresh food evaporator fan 216 is reduced or the fan 216 is deactivated during operation of the compressor 140, an amount of heat transferred via the fresh food evaporator 188 will be reduced, providing greater cooling capacity to the freezer compartment evaporator 190. In response to the fluid passageway 170 being opened, refrigerant is provided to both evaporators 188, 190, with the portion of refrigerant vaporized in the fresh food evaporator 188 returned to the compressor 140 via fluid output line 214 and fluid passageway 170. In another embodiment, the actuator 174 may be eliminated and selection of which compartment receives cooling capacity may be controlled solely via operation of the fresh food evaporator fan 216.

Figure 11A:
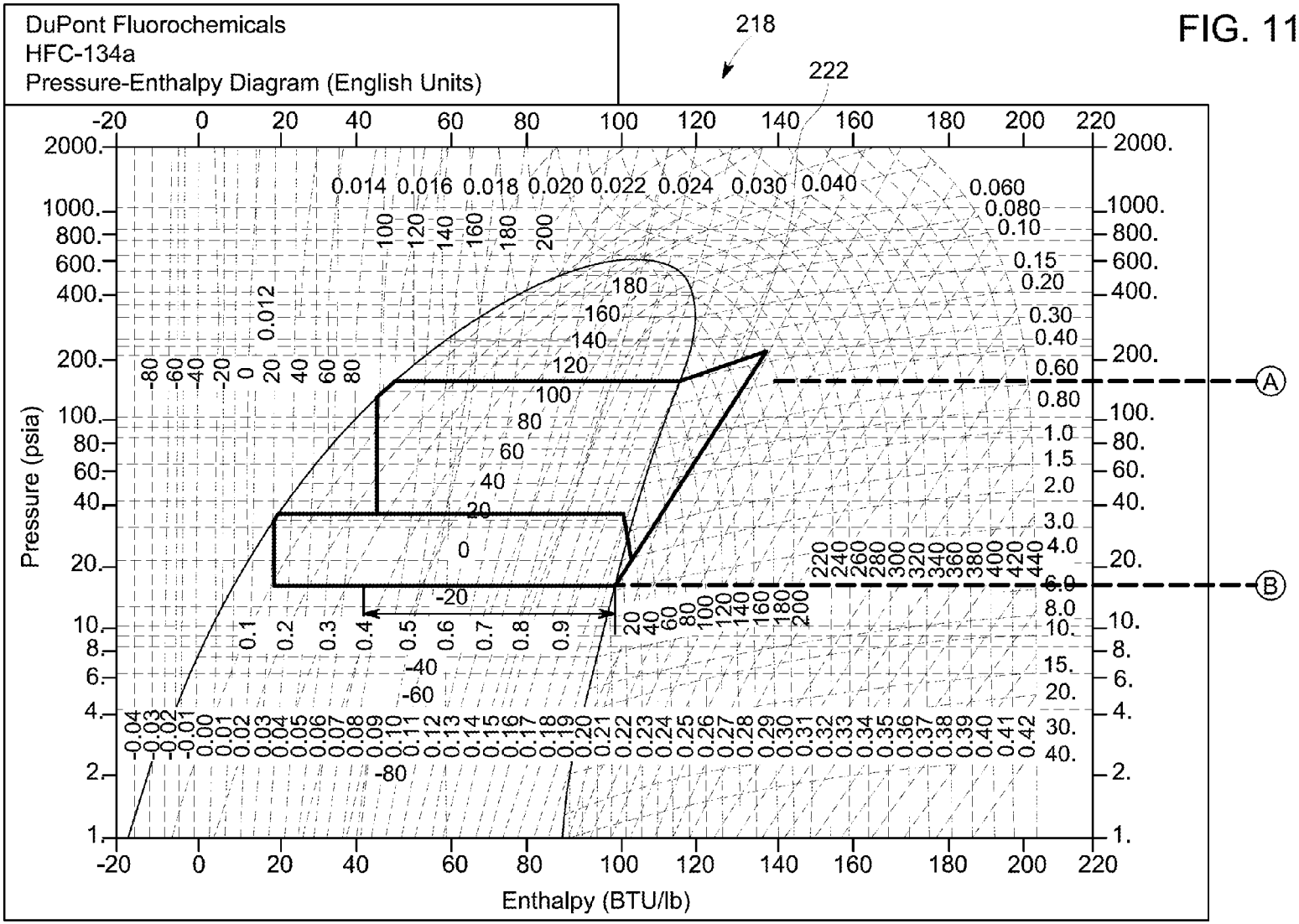
FIGS. 11(*a*) and 11(*b*) depict two pressure-enthalpy (Ph) diagrams corresponding to operation of the dual-evaporator refrigerator of FIG. 10 in accordance with an embodiment of the present disclosure.
Figure 11B:
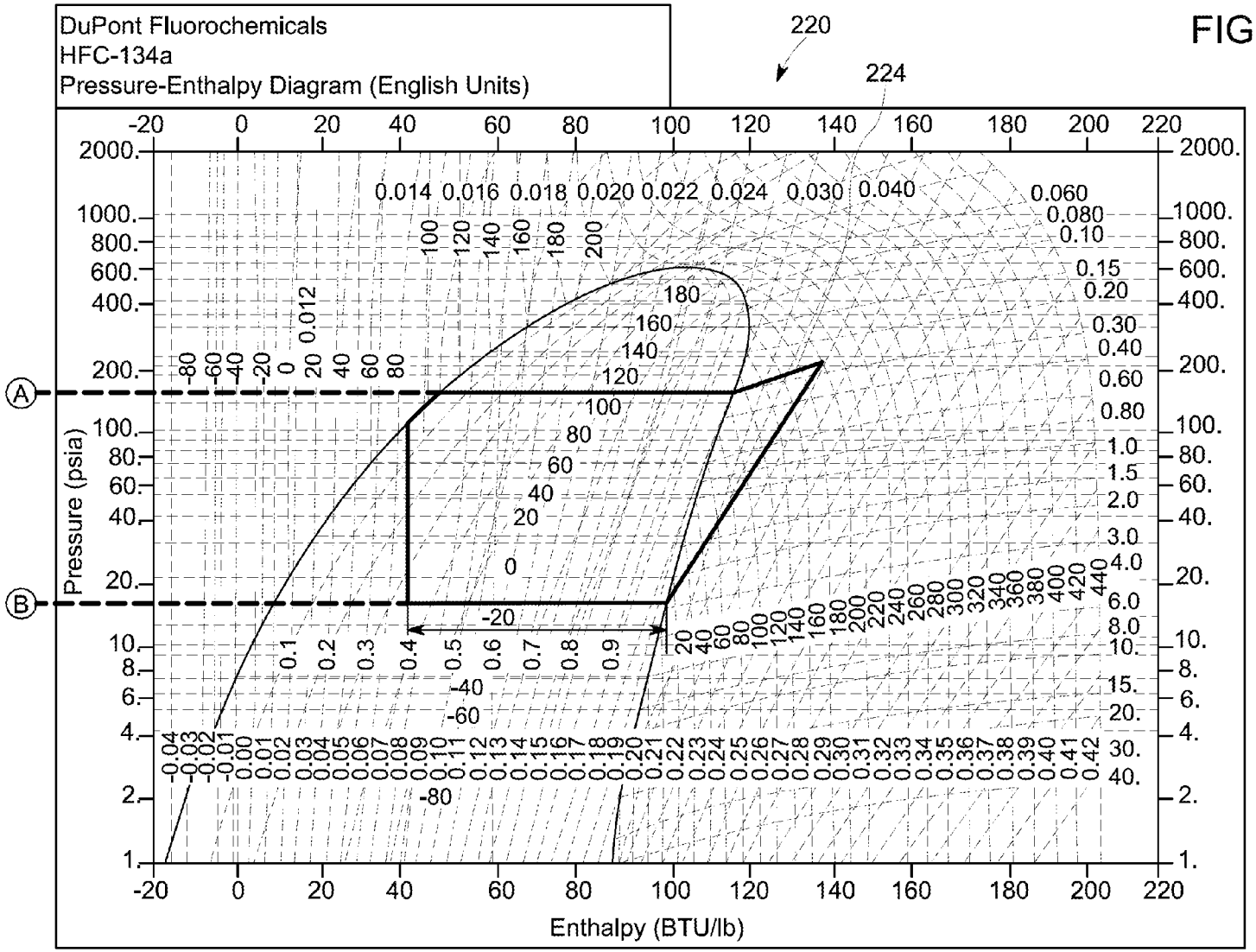

In an embodiment, placement of the fluid passageway 170 approximately midway between BDC 164 and TDC 162 provides a fresh food compartment 102 cooling capacity of approximately half of total cooling for the dual evaporator refrigerator 100 shown in FIG. 10. FIGS. 11(*a*) and 11(*b*) depict two Ph diagrams 218, 220 corresponding to an exemplary embodiment of the variable capacity compressor 140 used in the dual-evaporator refrigerator 100 shown in FIG. 10. With reference to FIGS. 3, 10, and 11(*a*), the Ph diagram 218 illustrates an exemplary vapor-compression refrigeration cycle 222 in accordance with activation of the fresh food compartment evaporator fan 216. At approximately 90 degree Fahrenheit ambient temperature testing, as depicted by Ph diagram 218, refrigerant pressure is contemplated to be approximately 16.5 psia through the freezer evaporator 190, approximately 34.5 psia through the fresh food evaporator 188, and approximately 150 psia through the condenser 142. Varying the speed of the evaporator fan 216, via controller 153, can vary the amount of fresh food compartment 102 cooling capacity as needed. The Ph diagram 220 of FIG. 11(*b*) illustrates an exemplary vapor-compression refrigeration cycle 224 in accordance with the fluid passageway 170 being disposed at approximately 50% of the stroke distance from BDC 164 toward TDC 162, and the fresh food compartment evaporator fan 216 being inactive. Operation of the compressor 140 at approximately 90 degree Fahrenheit ambient temperature with the fan 216 inactive, as depicted by Ph diagram 220, is contemplated to provide minimal cooling to the fresh food compartment 102 and result in cooling of only the freezer compartment 104, with refrigerant pressure of approximately 16.5 psia through the freezer compartment evaporator 190, and approximately 150 psia through the condenser 142.

In an embodiment of the dual evaporator refrigerator 100 design of FIG. 10, the controller 153 may be responsive to a high ambient temperature or greater cooling demand in the freezer compartment 104 to reduce (or stop) the speed of the fresh food evaporator fan 216 and/or increase the speed of the freezer evaporator fan 150 to begin, or increase, cooling of the freezer compartment 104. As described above, in an alternate embodiment, the controller 153 may close the fluid passageway 170 to increase cooling of the freezer compartment 104. The controller 153 may also be responsive to a low ambient temperature, an approach of temperature within the fresh food compartment 102 to a desired setpoint, or intended cooling of only the freezer compartment 104 evaporator 190 to deactivate the fresh food evaporator fan 216 and operate the compressor 140 to provide the full cooling capacity to the freezer compartment 104. The controller 153 may also be responsive to a need for cooling within the fresh food compartment 102, such as an elevation of temperature within the fresh food compartment 102 above a predetermined threshold. The controller 153 can activate the fresh food evaporator fan 216 and thereby provide a portion of the cooling capacity of the compressor 140 to each of the fresh food compartment 102 and freezer compartment 104. The maximum portion of the cooling capacity of the compressor 140 that will be provided to the fresh food compartment 102 is in direct relation the position of the fluid passageway 170, with increased distance from BDC toward TDC providing more cooling capacity to the fresh food compartment. An embodiment of the refrigerator 100 without the actuator 174, as depicted in FIG. 10, may provide reduced active control components reduced cost, and improved refrigerant management by reducing operational complexities associated with parallel dual evaporators known as refrigerant hiding, wherein after switching from operation of one of the fresh food or freezer evaporators to the other, the liquid refrigerant takes some time to return to the system because the cold liquid refrigerant in the evaporator that was just running remains a liquid longer due to the reduced heat transfer.

Figure 12:
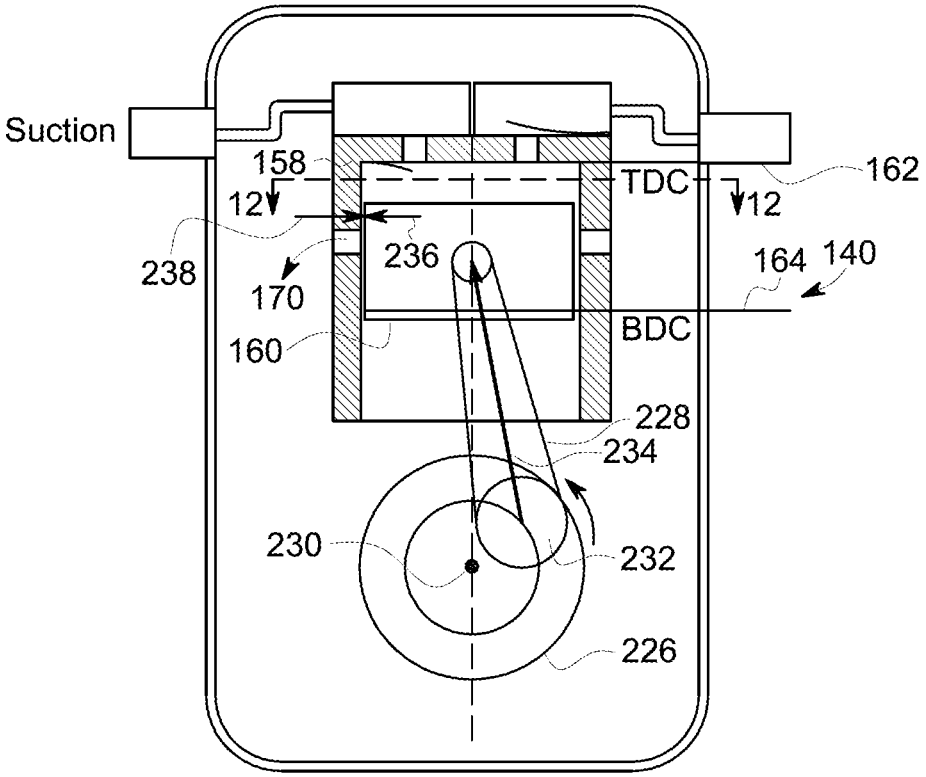
FIG. 12 depicts a cross section schematic diagram of a compressor illustrating forces acting upon the piston and cylinder in accordance with an embodiment of the present disclosure.

FIG. 12 depicts a schematic diagram of an exemplary compressor 140 illustrating forces acting upon piston 160 and cylinder 158. A crankshaft 226 is mechanically coupled to the piston 160 via a connecting rod 228. The connecting rod 228 is connected to crankshaft 226 eccentric to a center 230 of the crankshaft 226 and to the piston 160 at a wristpin 232. As the crankshaft 226 rotates around center 230, the connecting rod 228 forces the piston 160 to translate between the TDC 162 and BDC 164 positions. A force of the connecting rod is directed between the crankshaft 226 and the wristpin 232 and is depicted by vector 234. A component of the connecting rod force 234 perpendicular to the cylinder 158 is depicted by vector 236, and has a balancing reaction force from the cylinder 158 to the piston 160 depicted by vector 238.

Figure 13:
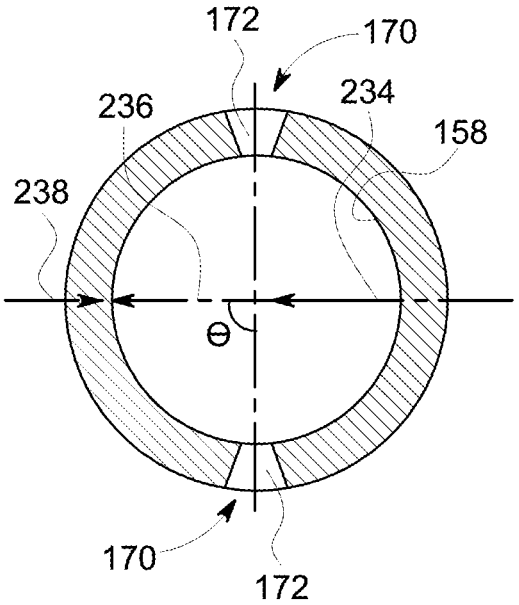
FIG. 13 depicts a top cross section view of the compressor of FIG. 12 in accordance with an embodiment of the present disclosure.

FIG. 13 depicts a top cross section view along line 12 of the compressor of FIG. 12, illustrating the force vectors 234, 236, 238. In an exemplary embodiment, the fluid passageway 170 are disposed out of the plane of force vectors 234, 236, 238 acting through the connecting rod 228, piston 160, and cylinder 158, by angle θ, such as 90 degrees, for example. That is, FIGS. 12 and 13 indicate that placement of the fluid passageway 170 and the cylinder 158 in the plane of force vectors 234, 236, 238 may be sub-optimal. While it may be possible to position fluid passageway 170, and the aperture(s) 172 that define the fluid passageway 170 in such a location, doing so may require a design modification to avoid an interference that may cause the piston 160 to catch on an edge of the fluid passageway 170. Placement of the holes for the fluid passageway 170 at an angle θ out of the plane of force vectors 234, 236, 238 reduces such risk.

Figure 14:
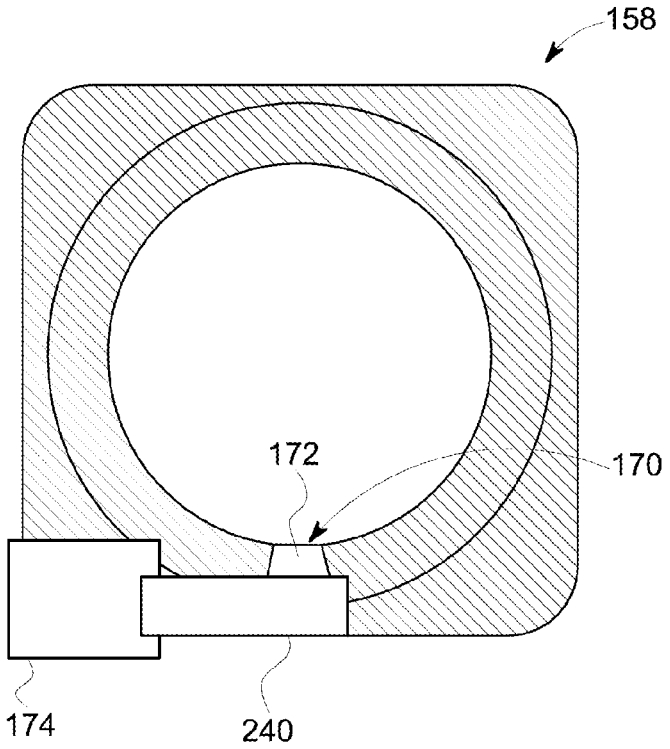
FIGS. 14 through 17 depict top cross section views of a single aperture and actuator combination for a compressor incorporating aspects of the present disclosure.
Figure 15:
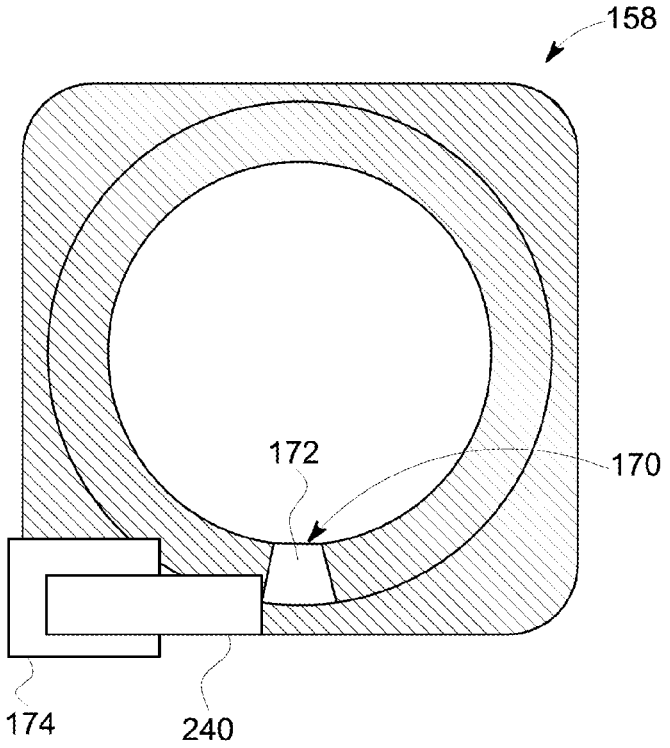

FIGS. 14 and 15 depict schematic views of an exemplary aperture 172 and actuator 174 combination for closing and opening a fluid passageway 170. In the example shown in FIGS. 14 and 15, the cylinder 158 includes a single fluid passageway 170 defined by a single aperture 172. The fluid passageway 170 and aperture 172 are modulated by a single actuator 174. In one embodiment, the actuator 174 is a linear actuator 174, driving a linear valve 240 disposed in operative communication with the aperture 172. As depicted in FIG. 14, the linear valve 240 is extended, and interferes with the aperture 172, thereby closing the aperture 172 and the fluid passageway 170 to provide the high pressure ratio and high capacity mode described above. FIG. 15 depicts the linear valve 240 retracted, and clear of the aperture 172, thereby opening aperture 172 and fluid passageway 170 to provide the low pressure ratio and low capacity mode described above. It will be appreciated that while an embodiment has been described with the actuator 174 operative to either open or close the aperture 172, the scope of the disclosure is not so limited, and is contemplated to include other modes of operation, such as to provide a partial, or metered opening of the aperture 172, via actuator 174 for example. In one embodiment, the actuator 174 may be a stepper motor to provide partial opening of the aperture 172. In another embodiment, two actuators 174 may be used with two apertures 172 (best seen with reference to FIGS. 13 and 18).

Figure 16:
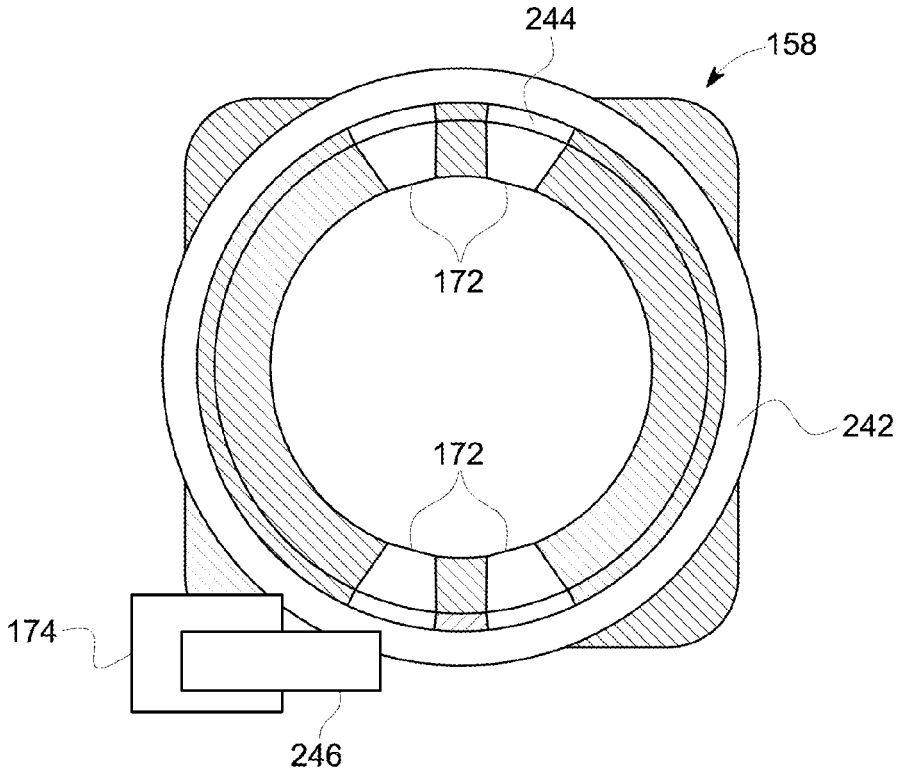
Figure 17:
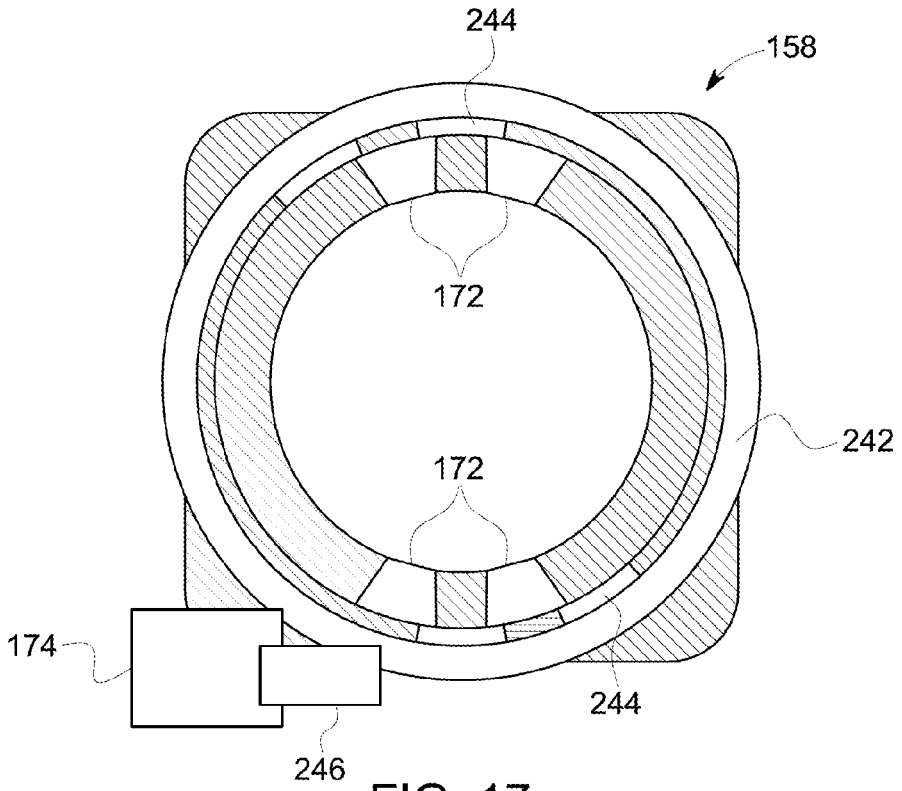

FIGS. 16 and 17 depict schematic views of another exemplary aperture 172 and actuator 174 combination for opening and closing the fluid passageway. In the example shown in FIGS. 16 and 17, the cylinder 158 includes a single fluid passageway defined by multiple apertures 172. The fluid passageway and apertures 172 are modulated by a single actuator 174. In one embodiment, the actuator 174 is a rotary actuator 174 including a ring 242 to which one or more sealing mechanisms 244, such as seals, are attached. The ring 242 is in operative communication with an extension arm 246 of the actuator 174. FIG. 16 depicts the extension arm 246 in a first position that disposes the ring 242 and seals 244 such that the seals 244 effectively close the apertures 172. FIG. 17 depicts the extension arm 246 in a second position such that the ring 242 and seals 244 are disposed to open the apertures 172.

FIGS. 18-21 illustrate examples of multiple apertures 172, referenced as 282, 292, with one actuator 174, referenced as 284, 294 per aperture. The apertures 282, 292 can define one or more fluid passageways 170, 270 depending on the position of each aperture 282, 292 from BDC. If both apertures 282, 292 are at the same distance from BDC, or in the same plane from BDC, as is shown in the example of FIG. 12, then the two apertures 282, 292 define a single fluid passageway 170. However, if one aperture 282 is at a different distance or plane from BDC than the other aperture 292, then the two apertures 282, 292, each define separate, or a first and a second, fluid passageways 170, 270, respectively. For purposes of explanation, in the example of FIGS. 18-19, a single fluid passageway 170 is defined by the two apertures 282, 292 in the same plane from BDC, where each aperture 282, 292 is controlled by a separate actuator 284, 294, respectively.

Figure 18:
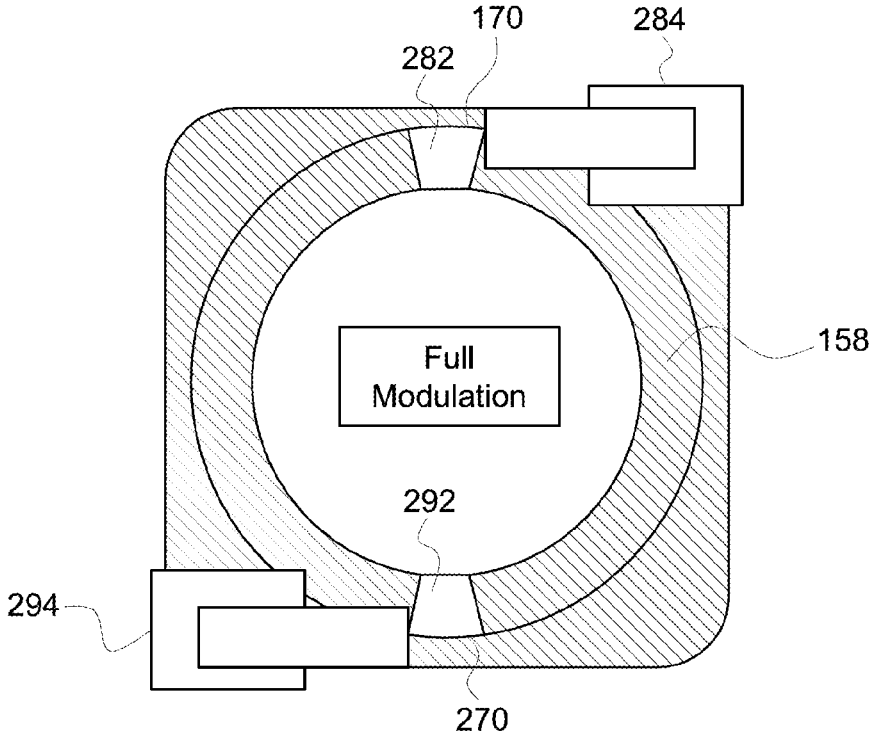
FIGS. 18-21 depict top cross section views of a multiple aperture and actuator combination for a compressor incorporating aspects of the present disclosure.
Figure 19:
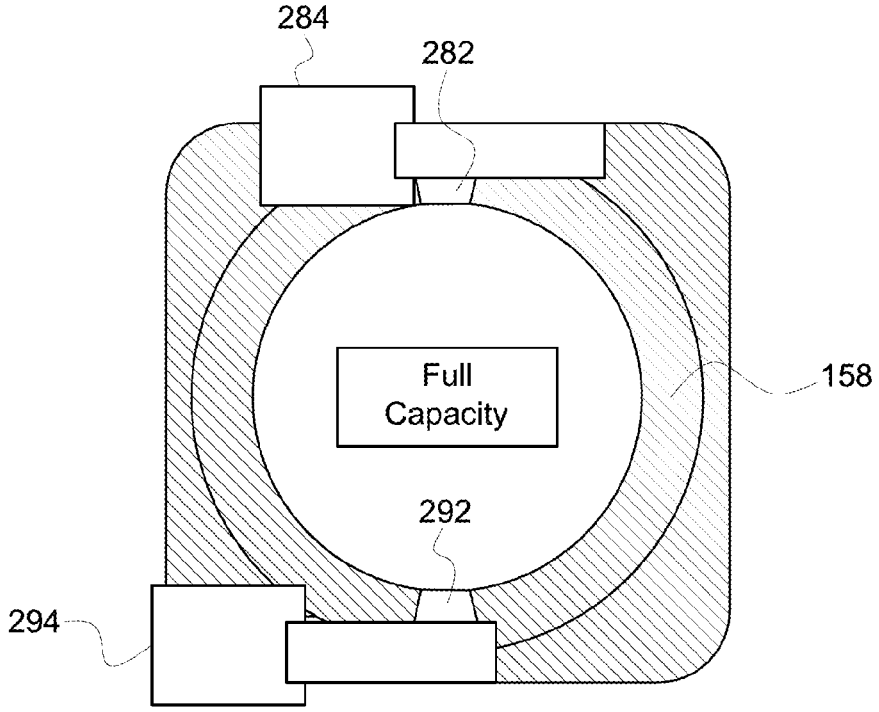

In the embodiments shown in FIGS. 18-19, the fluid passageway 170 is modulated either fully OPEN or fully CLOSED. In FIG. 18, each actuator 284, 294 maintains the respective aperture 282, 292 in the OPEN position. In FIG. 19, both apertures 282, 292 are in the CLOSED position by the actuators 284, 294 representing the full capacity state of the compressor 140.

Figure 20:
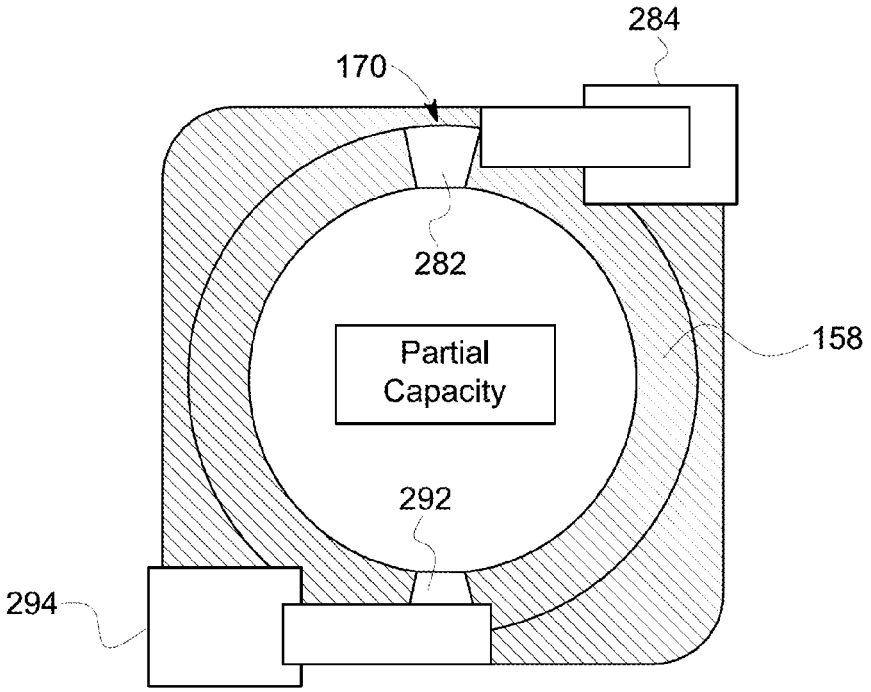
Figure 21:
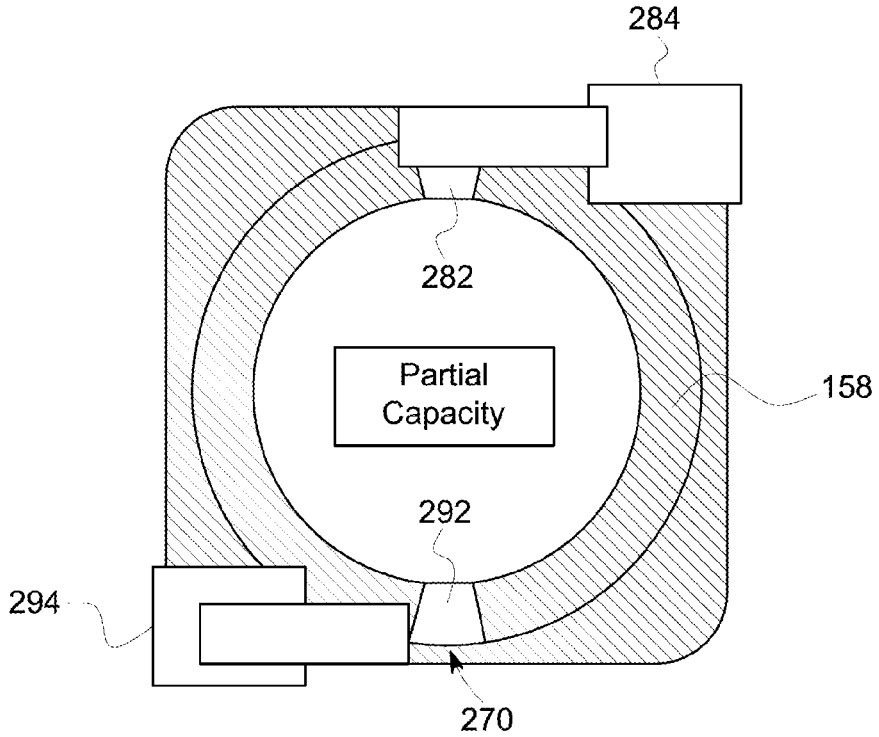

In FIGS. 20-21 illustrate partial capacity modulation of the fluid passageway 170. In FIG. 20, actuator 284 modulates aperture 282 in the OPEN position, while actuator 294 modulates the aperture 292 in the CLOSED position. In FIG. 21, the actuator 284 modulates aperture 282 in the CLOSED position, while actuator 294 modulates the aperture 292 in the OPEN position. Thus, in the embodiments of FIGS. 20-21, the fluid passageway 170 is at partial capacity. In one embodiment, the actuators 284 and 294 can only partially open or close each of the respective apertures 282, 292.

Locating the apertures 282, 292 at two different distances, or in two different planes from BDC in two different fluid passageways 170, 270, can be used to provide two different levels of capacity and pressure ratio reduction. In the example of FIG. 18, the two fluid passageways 170, 270 consist of one aperture each, 282 and 292, respectively, each controlled by one actuator 284, 294 per aperture 282, 292. For example, one aperture 282/actuator 284 combination can be disposed at a location that is 25% of the stroke distance from BDC 164 towards TDC 162 and the other aperture 292/actuator 294 combination can be disposed at a location that is 50% of the stroke distance from BDC 164 towards TDC 162. When all apertures 282, 292 are open, the compressor 140 will provide approximately 50% capacity modulation. When the 25% aperture/actuator combination 282/284 is closed, the compressor 140 should still provide approximately 50% capacity modulation. Closing the 50% aperture/actuator combination 292/294, with the 25% aperture combination 282/284 open, provides a 25% capacity reduction. Closing both apertures 282, 292 provides full capacity and pressure ratio.

Figure 22:
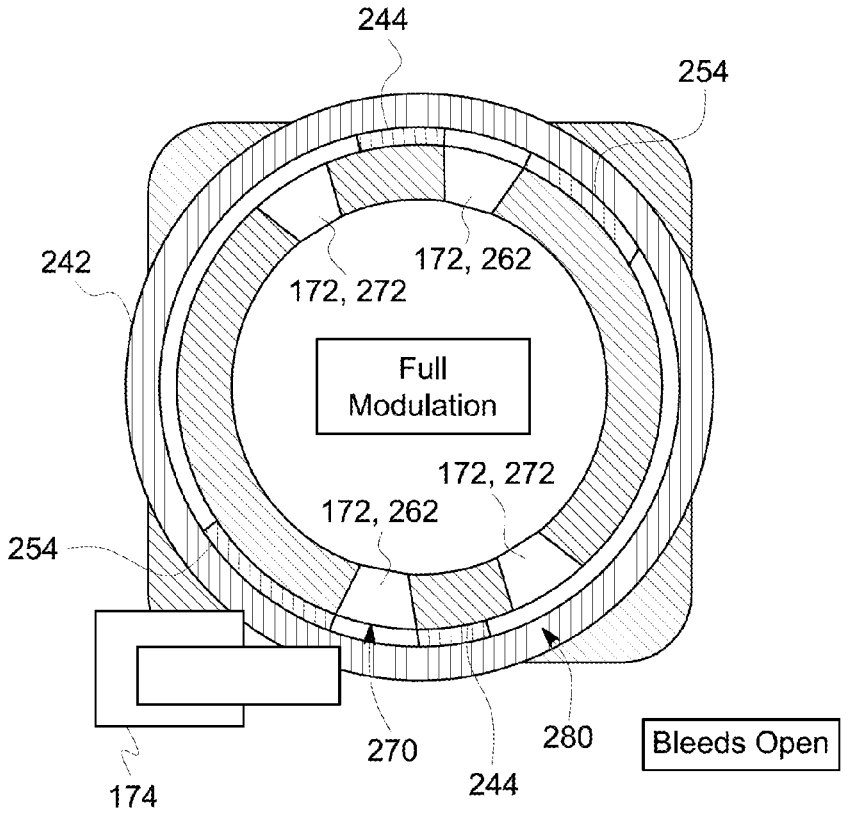
FIGS. 22-24 depict top cross section views of another embodiment of a multiple aperture and actuator combination for a compressor incorporating aspects of the present disclosure.
Figure 23:
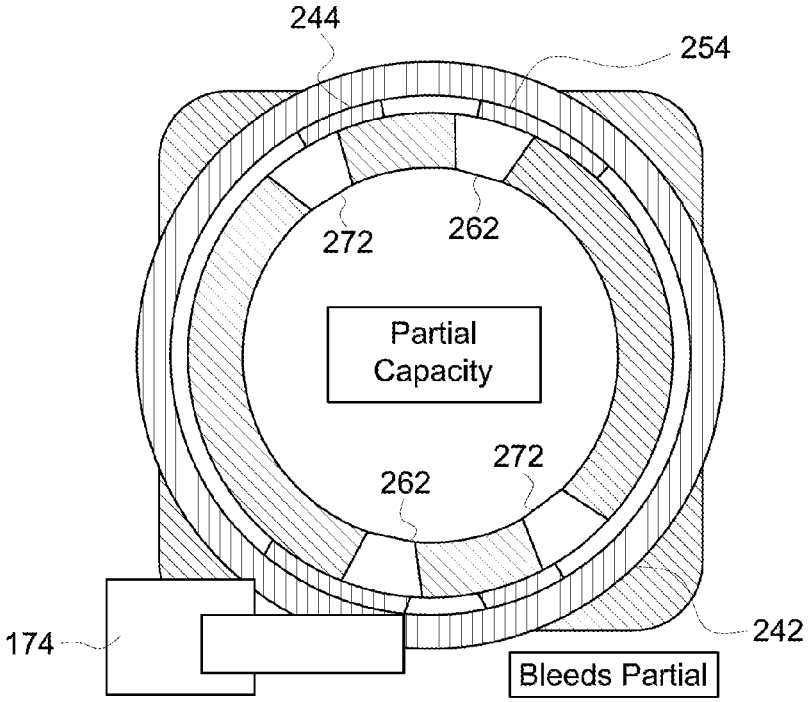
Figure 24:
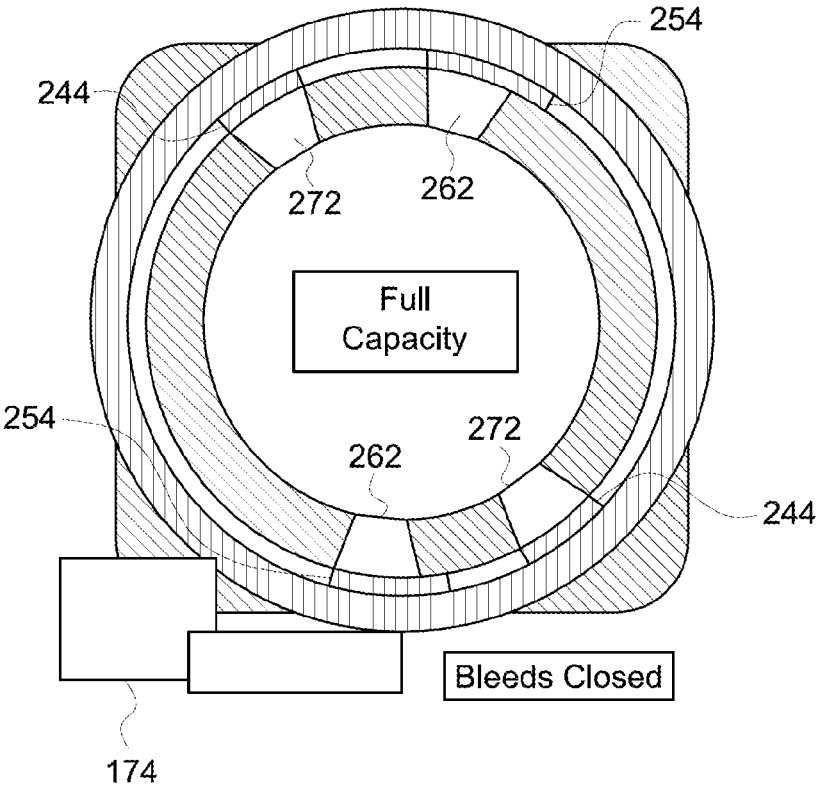

FIGS. 22-24 illustrate the multiple aperture embodiments of FIGS. 16 and 17, except that the seals or sealing mechanisms 244 of FIGS. 16 and 17, are now in different sizes. In the example shown in FIG. 22, the sealing mechanism 254 is wider than the sealing mechanism 244. In the example of FIGS. 16 and 17, when the actuator 174 rotates closed, the sealing mechanisms 244 simultaneously close each of the apertures 172 (which for purposes of this example are on the same plane from BDC). By spreading the apertures 172 at different distances and/or providing different sized sealing mechanisms 244, 254 as shown in FIGS. 22-24, one set 262 of apertures 172 can be closed first, and the second set 272 of apertures 172 can close if the actuator 174 is driven further to rotate the ring 242. When all four apertures 172 are the same distance from BDC, with one set 262 closing before the other set 272, the fluid passageway 170 is defined by the four apertures 172 controlled by a single actuator 174. Alternatively, one set of apertures 262 could be at one distance from BDC to form a first fluid passageway 270 and the other set 272 at a second distance to form a second fluid passageway 280, where each passageway 270, 280 is controlled by the single actuator 174, as is shown in FIGS. 22-24. Alternatively, each passageway 270, 280 can be controlled by a separate actuator 284. Although only two apertures are referenced with respect to each of the sets 262, 272, it will be understood that more than two sets of apertures can be used, each set of apertures can be defined by any number of apertures and each set does not have to have the same number of apertures.

FIG. 22 illustrates an embodiment where the apertures 172, or both aperture sets 262, 272 are in the fully OPEN state. FIG. 23 illustrates a partial capacity state, where the apertures 172 in aperture set 262 are CLOSED and the apertures 172 in aperture set 272 are OPEN. FIG. 24 illustrates a FULL capacity state, where both aperture pairs 262, 272 are CLOSED.

Figure 25:
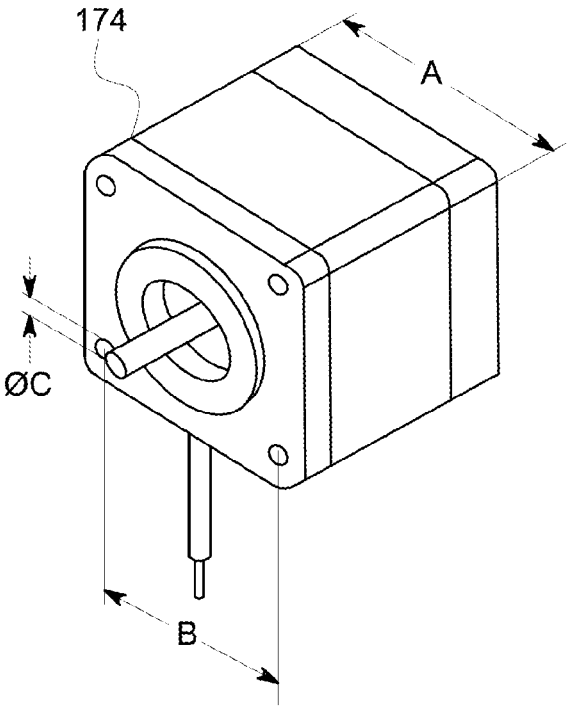
FIGS. 25 and 26 depict front perspective views of exemplary actuators for use in compressor incorporating aspects of the present disclosure.
Figure 26:
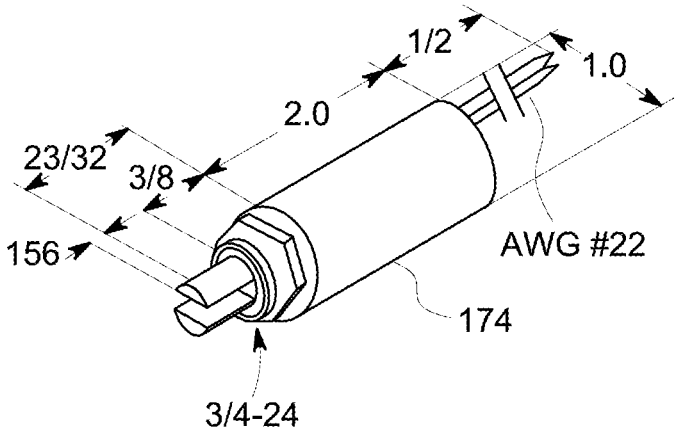

FIGS. 25 and 26 depict front perspective views of exemplary actuators 174 in accordance with embodiments of the disclosure. FIG. 25 depicts an exemplary embodiment of an actuator 174 that is a stepper motor and FIG. 26 depicts an exemplary embodiment of an actuator 174 that is a solenoid, or linear actuator, as would be appreciated by one of skill in the art.

While embodiments of the disclosure have been described with actuators having linear motion to dispose seals over the ports, it will be appreciated that the scope of the disclosure is not so limited, and is contemplated to include other sealing arrangements, such as rotary actuators that may open or close ball or needle valves, for example. Such arrangements, in conjunction with controlled motor movements, such as via stepper or servo motors, for example are contemplated to be capable to partially open the aperture 172 to control the opening size and accompanying refrigerant flow. Further, while embodiments have been described having one or more fluid passageways 170 that may define one capacity and pressure ratio with an accompanying actuator, it will be appreciated that the scope of the disclosure is not so limited, and includes other arrangements, such as to have multiple fluid passageways 170 at varying distances along the piston stroke to provide a variable capacity compressor having multiple capacities. Such embodiments with multiple capacity modulation steps are contemplated to include use of a stepper motor or multiple actuators to open and close the multiple fluid passageways 170 by controlling the opening and closing of the aperture(s) 172 defining the fluid passageways 170. Furthermore, while embodiments have been described with electrical actuators that drive a mechanism, it will be appreciated that the scope of the disclosure is not so limited, and includes other actuation arrangements, such as a valve that allows high pressure refrigerant to actuate the bleed ports, for example.

While embodiments of the disclosure have been illustrated with an actuator outside of the compressor, it will be appreciated that the scope of the disclosure is not so limited, and is contemplated to include additional arrangements, such as attachment of the actuator to the cylinder casting, or to the compressor shell, including embodiments known as lowside shells (which contain the low pressure of the suction line within the compressor shell), for example.

It is recognized that the aspects and benefits of the present disclosure apply to other types of appliances including single or multiple compartment refrigerators, single or multiple compartment freezers, combination refrigerator and freezers (including top mount or bottom mount systems), and other refrigeration devices, including but not limited to climate control systems including air conditioners and heat pumps, water coolers, wine coolers, ice makers, and vending machines having similar control issues and considerations. Consequently, the description set forth herein is for illustrative purposes only and is not intended to limit the present disclosure in any aspect.

Further embodiments may include a variable speed motor to provide additional benefits. The variable speed motor is in operative communication with the piston 160 via crankshaft 228 (best seen with reference to FIG. 12) and signal communication with the controller 153, as will be appreciated by one of skill in the art. Use of the variable capacity compressor 140 with a variable speed motor provides enhanced matching of the pressure ratio and the cooling capacity desired. For example, it may allow operation of fresh food compartment 102 of a dual evaporator refrigerator with an extreme capacity need to operate the motor at a faster speed to match the cooling requirement, at the lower pressure ratio to better match the fresh food compartment 102 operating point for pressures in the evaporator and condenser. That is, it allows enhanced matching of two customary operational compromises: to operate with the right pressure ratio with less cooling than is desired; and to operate with higher cooling capacity, but with a higher than desired pressure ratio. Use of the variable speed motor with the variable capacity compressor 140 provides additional degrees of freedom, allowing the proper pressure ratio to be set by the actuator 174 control of the aperture(s) 172, and the proper capacity set by the motor speed, for improved performance of the refrigerator. Likewise, based on an optimal operational pressure ratio for the freezer compartment 104, the actuators 174 control the aperture(s) 172 to close, but if there is a low heat load requirement, the compressor 140 speed could be reduced to better match the cooling requirement.

As disclosed herein, control of the actuator 174 to open and close the aperture(s) 172, and thus the fluid passageway 170, is based upon environmental conditions external to the compressor 140. That is, actuator 174 control is independent of any specific operating parameter of the sealed system, such as either a pressure or temperature of the refrigerant within the sealed system. Such independent control is contemplated to provide enhanced temperature control of the fresh food and freezer compartments 102, 104 because the compressor is controlled by logic within the controller 153 to create a more predictable cycle for the refrigerator 100. For example, one of the criteria for an energy test administered by the Association of Home Appliance Manufacturers is a stability criteria. The stability criteria specifies that cycles have temperatures within certain limits over a defined time interval. Using the controller 153 logic, responsive to operating conditions external to the sealed system, the stability criteria can be better satisfied than using operating conditions within the sealed system, such as evaporator superheat or an evaporator pressure as may typically be applied.

As disclosed herein, the fluid passageway 170 of the variable capacity compressor are in an initial, normally-opened state. Operation of the compressor with the fluid passageway 170 in the normally open state reduces an amount of required compressor start-up torque, allowing for a reduction in a size of the motor driving the compressor. This reduction in size allows for reduced motor excess design capacity and greater motor efficiency throughout the steady-state operating ranges of the compressor.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A reciprocating refrigerant compressor system comprising:

a cylinder;

a piston disposed within the cylinder and movable between a bottom dead center (BDC) and a top dead center (TDC) position;

at least one fluid passageway disposed within the cylinder at a position between the BDC and TDC position, the at least one fluid passageway defined by a plurality of apertures disposed at the position between the BDC and TDC positon;

at least one actuator in operative communication with the apertures; and a controller in signal communication with the actuator, the controller being responsive to an environmental condition external to the compressor system to activate the actuator to at least partially close the apertures, the controller activating the actuator to close the apertures asynchronously, the controller comprising a processor.

2. The system of claim 1, wherein the at least one fluid passageway comprises:

a first fluid passageway disposed at a first position with a first distance from BDC to TDC; and a second fluid passageway disposed at a second position with a second distance from BDC to TDC, the first distance being different from the second distance.

3. The system of claim 2, wherein:

the at least one actuator is in operative communication with each aperture defining the first and second fluid passageway; and the at least one actuator is responsive to the environmental condition external to the compressor system to at least partially close each aperture defining the first fluid passageway and the second fluid passageway.

4. The system of claim 2, wherein the at least one actuator comprises:

a first actuator in operative communication with at least one aperture defining the first fluid passageway, the first actuator responsive to an environmental condition external to the compressor system to at least partially close at least one aperture defining the first fluid passageway; and a second actuator in operative communication with at least one aperture defining the second fluid passageway, the second actuator responsive to an environmental condition external to the compressor system to at least partially close at least one aperture defining the second fluid passageway.

5. The system of claim 1, further comprising a crankshaft and a connecting rod coupling the crankshaft and the piston, the connecting rod connected to the crankshaft at a wristpin, the connecting rod connected to the crankshaft eccentric to a center of the crankshaft, wherein the connecting rod has a force directed between the crankshaft and the wristpin. along a first force vector, a component of the force perpendicular to the cylinder directed along a second force vector and a balancing reaction force of the cylinder directed along a third force vector, and wherein the at least one fluid passageway is disposed at an angle out of a plane of the first, second, and third force vectors.

6. A refrigerator comprising:

a cabinet;

a fresh food compartment and a freezer compartment within the cabinet;

a sealed system for forcing cold air through the fresh food and freezer compartments, the sealed system comprising a compressor comprising:

a cylinder;

a piston disposed within the cylinder and movable between a bottom dead center (BDC) and a top dead center (TDC) position;

a fluid passageway disposed within the cylinder at a position between the BDC and TDC position, the fluid passageway defined by a plurality of apertures disposed at the position between the BDC and TDC positon;

an actuator in operative communication with the apertures; and a controller in signal communication with the actuator, the controller being responsive to an environmental condition of the refrigeration compartment to activate the actuator to at least partially close the apertures to control fluid flow through the fluid passageway, the controller activating the actuator to close the apertures asynchronously, the controller comprising a processor.

7. The refrigerator of claim 6, wherein the fluid passageway is normally open.

8. The refrigerator of claim 6, wherein the fluid passageway comprises:

a first fluid passageway disposed at a first position with a first distance from BDC to TDC; and a second fluid passageway disposed at a second position with a second distance from BDC to TDC, the first distance being different from the second distance.

9. The refrigerator of claim 8, wherein:

the actuator is in operative communication with each aperture defining the first and second fluid passageway; and the controller is responsive to the environmental condition of the refrigeration compartment to activate the actuator to at least partially close each aperture defining the first fluid passageway and the second fluid passageway.

10. The refrigerator of claim 8, wherein the actuator comprises:

a first actuator in operative communication with the aperture defining the first fluid passageway; and a second actuator in operative communication with the aperture defining the second fluid passageway.

11. The refrigerator of claim 6, wherein the aperture defining the fluid passageway comprises a first aperture and a second aperture, each aperture being selectively controlled by the actuator to close the fluid passageway.

12. The refrigerator of claim 6, wherein the fluid passageway is defined within the cylinder at a distance disposed approximately 25% of the stroke distance from BDC toward TDC.

13. The refrigerator of claim 6, wherein the sealed system further comprises:

a condenser in serial fluid communication downstream from the compressor;

a fresh food expansion device and a freezer expansion device in parallel fluid communication downstream from the condenser;

a fresh food evaporator and a freezer evaporator disposed in the respective fresh food compartment and freezer compartment and in serial fluid communication downstream from the respective fresh food expansion device and freezer expansion device; and a suction plenum coupling the fresh food evaporator and freezer evaporator in parallel fluid communication upstream from the compressor.

14. The refrigerator of claim 6, wherein the sealed system further comprises:

a condenser in serial fluid communication downstream from the compressor;

a fresh food expansion device and a a freezer expansion device in parallel fluid communication downstream from the condenser; and a fresh food evaporator and a freezer evaporator disposed in the respective fresh food compartment and freezer compartment and in serial fluid communication downstream from the respective fresh food expansion device and freezer expansion device, the fresh food evaporator in serial fluid communication upstream from the compressor via the fluid passageway.

15. The refrigerator of claim 6, wherein the sealed system further comprises:

a condenser in serial fluid communication downstream from the compressor;

a fresh food expansion device in serial fluid communication downstream from the condenser;

a fresh food evaporator disposed in the fresh food compartment and in serial fluid communication downstream from the fresh. food expansion device;

a phase separator in serial fluid communication downstream from the fresh food evaporator, the phase separator having a liquid phase output and a vapor phase output, the vapor phase output in serial fluid communication upstream from the compressor via the fluid passageway;

a freezer expansion device in serial fluid communication downstream from the liquid phase output; and a freezer evaporator disposed in the freezer compartment and in serial fluid communication downstream from the freezer expansion device and upstream from the compressor.

16. The refrigerator of claim 15, wherein the fluid passageway is defined within the cylinder at a distance disposed approximately 50% of the stroke distance from BDC toward TDC.

17. The refrigerator of claim 6, wherein the actuator comprises a linear solenoid or a stepper motor.

18. The refrigerator of claim 6, further comprising:

a variable speed motor in operative communication with the piston and signal communication with the controller;

wherein the controller is further configured to modulate an operating speed of the variable speed motor based upon an environmental condition of the refrigeration compartment.

19. A reciprocating refrigerant compressor system comprising;

a compression chamber circumscribed by a chamber wall;

a piston disposed within the compression chamber for reciprocating movement between a first position and a second position for compressing refrigerant received in the chamber;

a plurality of apertures in the chamber wall disposed at a position between the first position and the second position, the apertures defining a fluid passageway through said chamber wail;

at least one actuator operative to selectively at least partially close one aperture of the plurality of apertures, thereby selectively changing the effective cooling capacity of the compressor system;

at least one sensor for sensing an external condition; and a controller for controlling said at least one actuator, said controller being responsive to said at least one sensor and operative to selectively acuate the at least one actuator to position a sealing mechanism relative to the one aperture to at least partially close said aperture in response to the sensed condition, the controller comprising a processor.

* * * * *